US005469015A

United States Patent [19]

Kaneko et al.

[11] Patent Number: 5,469,015

[45] Date of Patent: Nov. 21, 1995

[54] FUNCTIONAL VACUUM MICROELECTRONIC FIELD-EMISSION DEVICE

[75] Inventors: Akira Kaneko, Tokyo; Toru Kanno; Keiko Morishita, both of Kawasaki, all of Japan

[73] Assignee: Matsushita Electric Industrial Co., Ltd., Osaka, Japan

[21] Appl. No.: 227,228

[22] Filed: Apr. 13, 1994

Related U.S. Application Data

[63] Continuation of Ser. No. 800,371, Nov. 29, 1991, abandoned.

[30] Foreign Application Priority Data

| | | | |
|---|---|---|---|
| Nov. 28, 1990 | [JP] | Japan | 2-332411 |
| Nov. 28, 1990 | [JP] | Japan | 2-332412 |
| Mar. 26, 1991 | [JP] | Japan | 3-061574 |
| Nov. 26, 1991 | [JP] | Japan | 3-310491 |

[51] Int. Cl.[6] ..... H01J 1/30

[52] U.S. Cl. ..... 313/309; 313/308; 313/336; 313/351; 313/355

[58] Field of Search ..... 373/309, 308, 373/306, 336, 351, 355; 315/169.4; 345/75

[56] References Cited

U.S. PATENT DOCUMENTS

| | | | |
|---|---|---|---|
| 4,163,949 | 8/1979 | Shelton | 313/309 X |
| 4,578,614 | 3/1986 | Gray et al. | 313/336 X |
| 4,904,895 | 2/1990 | Tsukamoto et al. | 313/336 |
| 4,987,377 | 1/1991 | Gray et al. | 313/309 X |
| 5,189,341 | 2/1993 | Itoh et al. | 313/309 X |
| 5,204,581 | 4/1993 | Andreadakis et al. | 313/309 X |
| 5,214,346 | 5/1993 | Komatsu | 313/309 |
| 5,217,401 | 6/1993 | Watanabe et al. | 313/309 X |
| 5,243,252 | 9/1993 | Kaneko et al. | 313/309 |

FOREIGN PATENT DOCUMENTS 0260075 3/1988 European Pat. Off. .

OTHER PUBLICATIONS

"Vacuum microtriode characteristics" by W. N. Carr, et al; J. Vac. Sci. Technol. A 8 (4), Jul./Aug. 1990, pp. 3581–3585.

"Fabrication and Operation of Silicon Micro–Field–Emitter–Array" by Keiichi BETSUI, Autumn Meeting of Japanese Society of Electronics and Information Communications, pp. 5–282–5–283.

"Fabrication and characterization thin film field emiters" by Junji Itho, et al, Report on the 3rd International Vacuum Microelectronics Conference, 1990, p. 1209.

"A vacuum field effect transistor using silicon field emitter arrays" by H. F. Gray, et al, IEDM 86, pp. 766–779.

*Primary Examiner*—Sandra L. O'Shea
*Assistant Examiner*—Ashok Patel
*Attorney, Agent, or Firm*—Lowe, Price, LeBlanc & Becker

[57] ABSTRACT

A vacuum microelectronic field-emission device includes: a substrate; an emitter portion formed to have at least an wedge portion extending in parallel to the substrate, the emitter portion being supported by the substrate; a gate portion formed a first given distance apart from the tip of the emitter portion, the gate portion being supported by the substrate, the gate portion being electrically insulated from the emitter portion; and a collector portion formed a second given distance apart from a tip of the emitter portion, the collector portion being supported by the substrate, the second given distance is equal to or larger than the first given distance, the collector portion being electrically insulated from the emitter portion and the gate portion.

26 Claims, 24 Drawing Sheets

FUNCTIONAL VACUUM MICROELECTRONIC FIELD-EMISSION DEVICE

This application is a continuation of application Ser. No. 07/800,371 filed Nov. 29, 1991, now abandoned.

BACKGROUND OF THE INVENTION

1. Field of the Invention

This invention relates to a functional vacuum microelectronic device.

2. Description of the Prior Art

Recently, with growing development of the fine processing technique, the research and the study for the vacuum microelectronic filed-emission devices (VMFE), namely, the cold cathode devices, have become active. Some types of them are studied well because they have various advantageous effects. In the functional vacuum microelectronic field-emission devices, electron emission is carried out by a strong electric field of about $10^7$V developed by concentrating electric lines of force at a tip of an emitter which is processed to have a needle shape such that a curvature of the tip of the emitter is less than hundreds nanometers in order to emit electrons. The tip of the emitter is formed in the vertical direction with respect to the substrate.

As a new device using the above-mentioned microelectronic field-emission device, a vacuum transistor of the field-emission type disclosed in IEDM 86, 33.1, p776 is proposed. Its structure will be described with reference to drawings. FIG. 24 is a cross-sectional view of a prior art field-emission type vacuum transistor.

In FIG. 24, silicon Si is used for a substrate 200. A conical emitter 201 as an electron emitting portion which is formed by processing the substrate 200. On the substrate 200, an insulation layer 202 made of $SiO_2$ is formed around the emitter 201. A gate 203 and a collector 204 are formed on the insulation layer 202 at a given intervals. A bias power supply 206 and a signal input portion 205 connected in series are connected between the emitter 200 and the gate 203. A load resistor 207 and a collector power supply 208 connected in series are connected between the emitter 201 and the collector 204.

In the above-mentioned structure, when a suitable bias potential is applied between the gate 203 and the emitter 201 by the bias power supply 206 and a voltage of the signal input portion 205 is changed, electrons 211 can be emitted from the emitter 201 in accordance with a sum voltage of the bias voltage and an input signal voltage, i.e., a voltage between the gate 203 and the emitter 201. In this state, electrons 211 emitted into a vacuum space can be taken into the collector 204 by application of a sufficient voltage by the collector power supply 208. As the result, a current flows in the resistor 207, so that a voltage between the terminals 209 and 210 will change. That is, a voltage of an output terminal 210 of the collector 204 can be changed in accordance with the voltage change of the signal input portion 205. That is, some type of transistor operation or switching operation is achieved. Moreover, in this vacuum microelectronic field-emission device, a high speed operation is possible because electrons runs through a vacuum space as against that electrons run through a solid material in the transistor.

However, in the above-mentioned prior art, a semiconductor material is used for the emitter and processing of the emitter 201 is carried out by anisotropic etching using a unique characteristic of its material. As mentioned, because the material of the emitter 201 is a semiconductor, a work function become higher than that of the metal material, so that a quantity of electron emission becomes small. Accordingly, a signal output level become small, so that there is a problem that its characteristic cannot be utilized sufficiently as a switching device, etc.

Moreover, there is proposed a new device using the above-mentioned small vacuum microelectronic field-emission device is proposed as a three-terminal device shown in FIG. 25, disclosed in the papers of lecture of No. 51 meeting of The Japan Society of Applied Physics, 1990, p1209. FIG. 25 is a plan view of the three-terminal device of a prior art and FIG. 26 shows a cross section taken on line K—K shown in FIG. 25. Hereinbelow will be described its structure with reference to FIGS. 25 and 26. The three-terminal device has, on a substrate 251, a sawtooth-shaped emitter 252, a gate 253 formed a given interval apart from a tip of the emitter 252 and the gate portion is formed in a cylindrical-shape, and an anode 254 formed a given interval apart from the gate 253 on the opposite side of the gate 253 from the emitter 252. Grooves are made by removing portions of the substrate 251 between the emitter 252 and the gate 253, and between the gate 253 and the anode 254.

The production method of the three-terminal device will be described with reference to FIGS. 27A to 27E. As shown in FIG. 27A, a tungsten (W) film 262 is formed on a substrate 261. Then, a resist is formed in a given shape on the tungsten film 262. Then, as shown in FIG. 27B, the tungsten film 262 is etched using the resist 263 as a mask. Then, as shown in FIG. 27C, a resist 265 is formed again in a given shape to form portions of the gate 264 into a cylindrical shape. After this, as shown in FIG. 27D, the tungsten film 262 is etched again. As mentioned above, the emitter 266, gate 264, and an anode 267 are formed. Finally, as shown in FIG. 27E, portions of the substrate are removed by etching to form the grooves.

Hereinbelow will be described operation of the three-terminal device having the above-mentioned structure. In FIG. 25, electrons are emitted from the emitter 252 when a voltage is applied between the emitter 252 and the gate 253 such that a potential of the emitter 252 is negative and a potential of the gate 253 is positive and an electric field whose intensity is higher than a given value. The amount of emitted electrons can be changed by variation of the applied voltage. The electrons emitted from the emitter 252 can be taken into the anode 254 by applying a sufficient voltage to the anode 254. That is, the amount of electrons flowing into the anode can be changed by variation of a voltage between the emitter 252 and the gate 253. Therefore, a kind of transistor or switching operation is achieved. Moreover, in this vacuum microelectronic field-emission device, a high speed operation is possible because electrons run through a vacuum space as against that electrons run through a solid material in the transistor.

However, in the above-mentioned prior art structure, positioning is necessary because resist-patterning is carried out twice in the production method. Therefore, because a fine processing technique is required, there is a problem in reproducibility and stability of characteristics of the device.

SUMMARY OF THE INVENTION

The present invention has been developed in order to remove the above-described drawbacks inherent to the conventional functional vacuum microelectronic field-emission device.

This invention provides decrease in operation voltage and an amount of emission of electrons by using a material for the emitter portion whose work function is low. Thus, an level of the output signal can be increased and S/N ratio can be improved. The aim of the invention is providing a functional vacuum microelectronic field-emission device such that yield is improved because of a simple production method, and thus reliability is improved.

This invention provides a functional vacuum microelectronic field-emission device having high reproducibility and stability and a production method capable of easy production of the device.

According to the present invention there is provided a vacuum microelectronic field-emission device comprising: a substrate; an emitter portion formed to have at least a wedge portion extending in parallel to the substrate, the emitter portion being supported by the substrate; a gate portion formed a first given distance apart from the tip of the emitter portion, the gate portion being supported by the substrate, the gate portion being electrically insulated from the emitter portion; and a collector portion formed a second given distance apart from a tip of the emitter portion, the collector portion being supported by the substrate, the second given distance is equal to or larger than the first given distance, the collector portion being electrically insulated from the emitter portion and the gate portion.

According to the present invention there is also provided a vacuum microelectronic field-emission device comprising: a substrate; an emitter portion formed to have at least a wedge portion extending in parallel to the substrate, the emitter portion being electrically connected to the conductive layer, the emitter portion being supported by the substrate; a gate portion formed a first given distance apart from the tip of the emitter portion such that it substantially encloses the emitter portion, the gate portion being supported by the substrate, the gate portion being electrically insulated from the emitter portion; and a collector portion formed a second given distance apart from the tip of the emitter portion such that it substantially encloses the gate portion, the collector portion being supported by the substrate, the collector portion being electrically insulated from the emitter and the gate portions.

BRIEF DESCRIPTION OF THE DRAWINGS

The object and features of the present invention will become more readily apparent from the following detailed description taken in conjunction with the accompanying drawings in which.

The same or corresponding devices or parts are designated as like references throughout the drawings.

DETAILED DESCRIPTION OF THE INVENTION

Hereinbelow will be described a first embodiment of this invention with reference to FIGS. 1 and 2.

Figure 1:
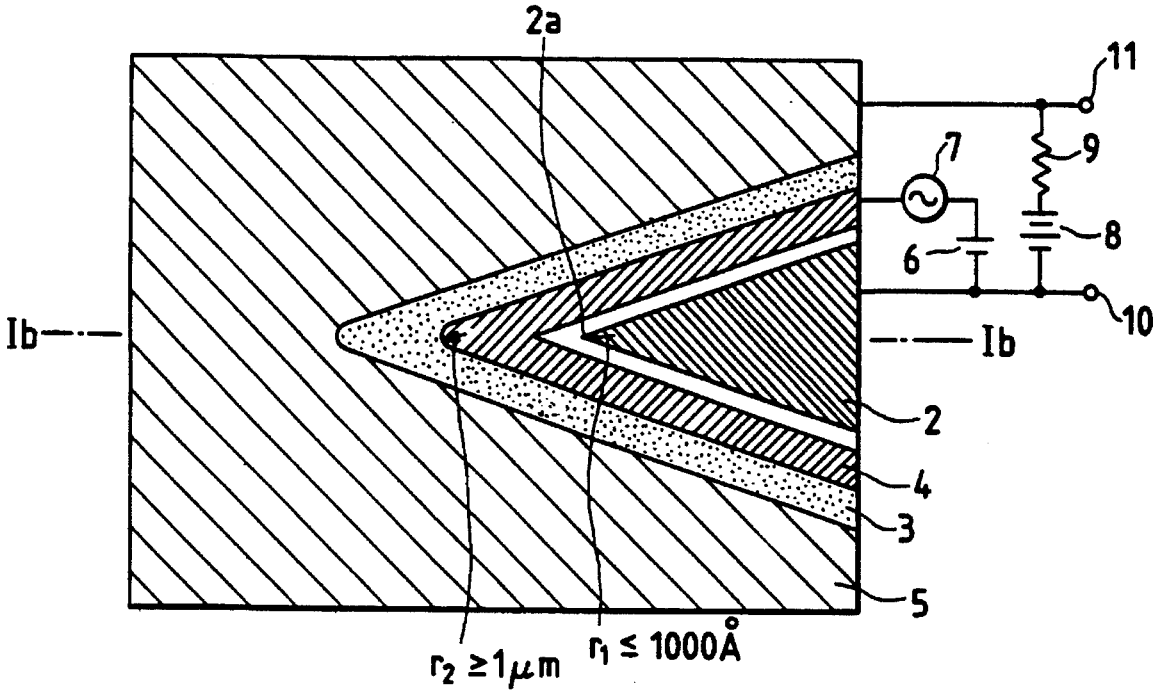
FIG. 1 is a plan view of a first embodiment of the invention of a functional vacuum microelectronic field-emission device of this invention.

FIG. 1 is a plan view of the first embodiment of the invention of a functional vacuum microelectronic field-emission device of this invention. FIG. 2 shows a cross section taken on line Ib—Ib shown in FIG. 1. Portions with various markings in a plan view correspond to portions marked similarly in the corresponding cross-sectional view throughout the specification.

Figure 2:
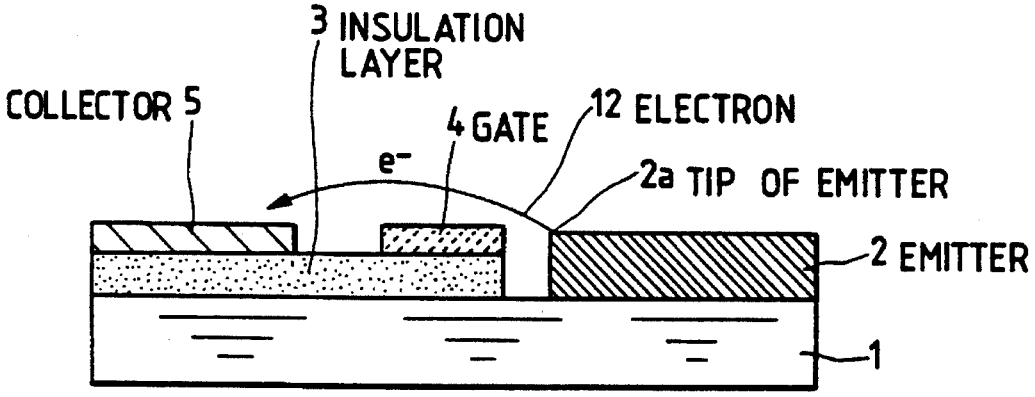
FIG. 2 shows a cross section taken on line Ib—Ib shown in FIG. 1.

As shown in FIGS. 1 and 2, an emitter (cathode) 2 is formed on an insulation substrate 1 made of glass, ceramic, etc. (a metallic substrate can be used also). The emitter 2 is made of a material having a low work function such as Mo, Ta, W, ZrC, $LAB_6$, etc. A width (seen in FIG. 1) of at least a portion of the emitter successively changes substantially lineally, so that a tip 2*a* is formed sharply. That is, the is formed to have a wedge portion. On the substrate 1, an insulation layer 3 made of $SiO_2$, $Si_3N_4$, $Al_2O_3$, $Ta_2O_5$, etc. is formed a given interval apart from the wedge portion of the emitter 2. On the insulation layer 3, at least a gate 4 made of Mo, Ta, Cr, Al, or Au, etc. is formed a given interval apart from the outside of the wedge portion of emitter 2. On the insulation layer 3, a collector (anode) 5 made of Mo, Ta, Cr, Al, or Au, etc. is formed a given interval apart from the gate 4 on the outside of the gate 4 from the wedge portion of emitter 2. The insulation layer 3 is provided to adjust a height of the gate 4 from the substrate 1 to control emission of electrons 12 or drawing-out of the electrons from the emitter 2 by the gate 4. However, if the substrate 1 is made of a conductive material, the insulation layer 3 acts as an insulator also. In this embodiment, the gate is formed to have a V-shape. Numerals 6 and 7 are a bias power source and a signal input portion respectively. Numerals 8 and 9 are a collector power source and a resistor connected between the emitter 2 and collector 5. Numeral 10 and 11 are terminals. Numeral 12 are electrons emitted from the tip 2*a* of the emitter 2. The tip 2*a* is formed to have a radius r1 of the tip 2*a* which is equal to or less than 1000 angstroms. On the other hand, The tip of the V-shaped gate is formed to have a radius r2 thereof which is equal to or larger than 1 micrometer.

Hereinbelow will be described operation of the first embodiment.

As mentioned above, for example, the bias power supply 6 and the signal input portion 7 are connected between the emitter 2 and the gate 4. A collector power supply 8 and the resistor 9 are connected between the emitter 2 and the collector 5. This functional vacuum microelectronic field-emission devices are placed in a vacuum space in use. At first, a suitable bias voltage is applied between the emitter 2 and gate 4 by the bias power supply 6. Then, when a suitable voltage is inputted from the signal input portion 7, the voltage between the emitter 2 and the gate 4 is a combined voltage of the bias voltage and the input signal voltage. Therefore, an electric field whose intensity determined in accordance with the combined voltage is applied to the emitter 2. At this point, electric fields at respective surfaces of the emitter 2 are determined by geometrical position relations between the gate 4 and the respective surfaces of the emitter 2. As a result of a simulation analyzing about such arrangement, it has been known that lines of electric force are concentrated at the sharp tip 2*a* of the wedge portion of the emitter 2, that is, an electric field is strong at the tip 2*a*. Electron emission is caused by electric fields at respect points of the emitter 2, which are determined in accordance with the combined voltage. In the wedge-shaped emitter 2, almost all electrons 12 can be emitted from the tip portion 2*a* of the emitter 2 because the electric field is strong at the tip portion 2*a* as mentioned above. In this state, electrons emitted into the vacuum space can be taken into the collector 5 by application of a sufficient positive voltage to the collector 5 by the collector power supply 8. Accordingly, a current flows through the resistor 9, so that a voltage between terminals 10 and 11 changes. That is, an output can be obtained as a change in the output voltage from the output terminal of the collector 5 in accordance with a voltage change of the signal input portion 7. Moreover, it is possible that a material having a low work function is used as the material of the emitter 2 because anisotropic etching is not carried out. Therefore, the signal output level can be increased and S/N ratio is improved.

Hereinbelow will be described, an example of production processing of the functional vacuum microelectronic field-emission device of the above-mentioned fist embodiment with reference to FIGS. 3A to 3E.

Figure 3A:
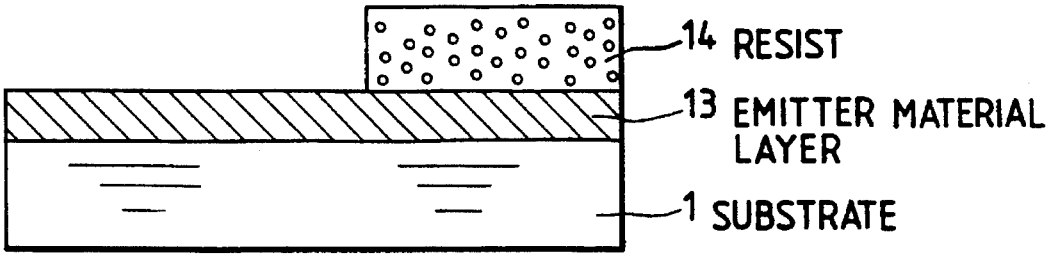
FIGS. 3A–3E show cross sections for showing an example of production processing of the functional vacuum microelectronic field-emission device of the fist embodiment.
Figure 3B:
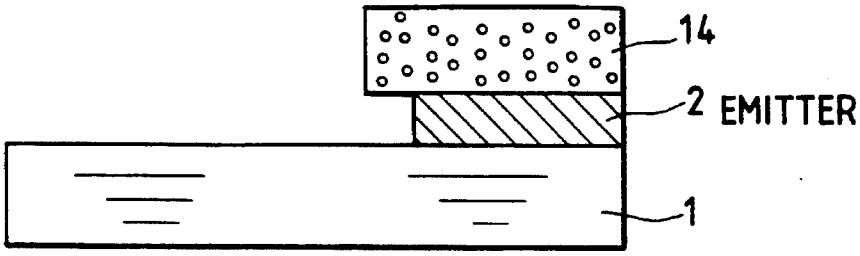
Figure 3C:
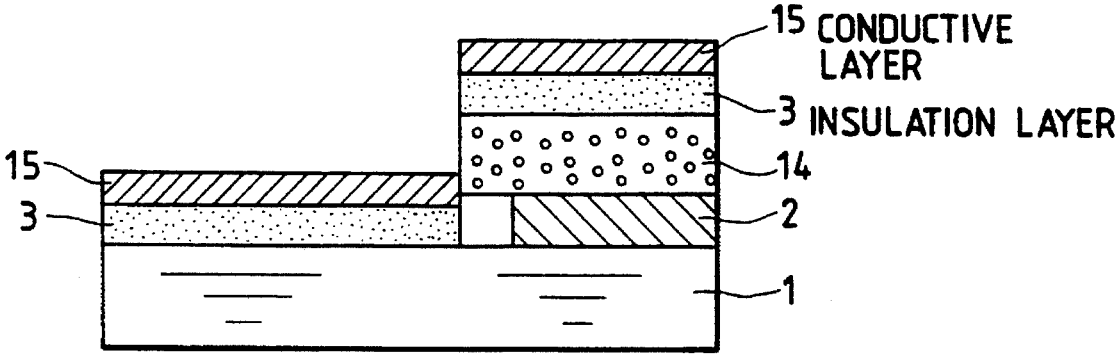
Figure 3D:
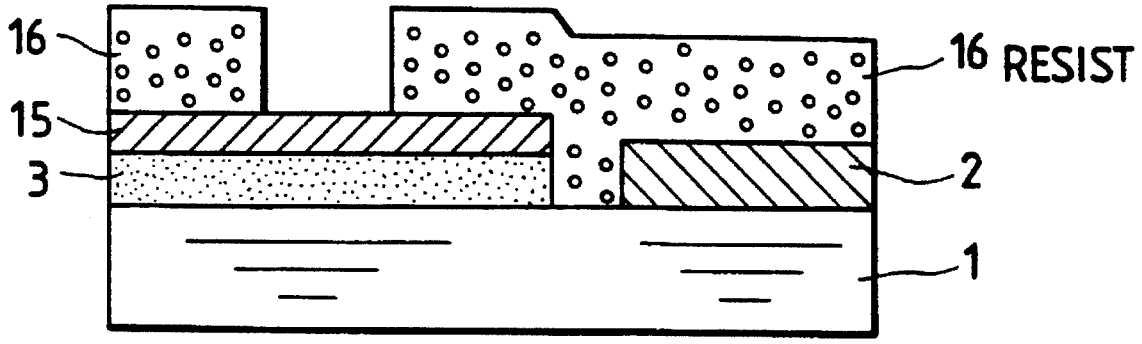
Figure 3E:
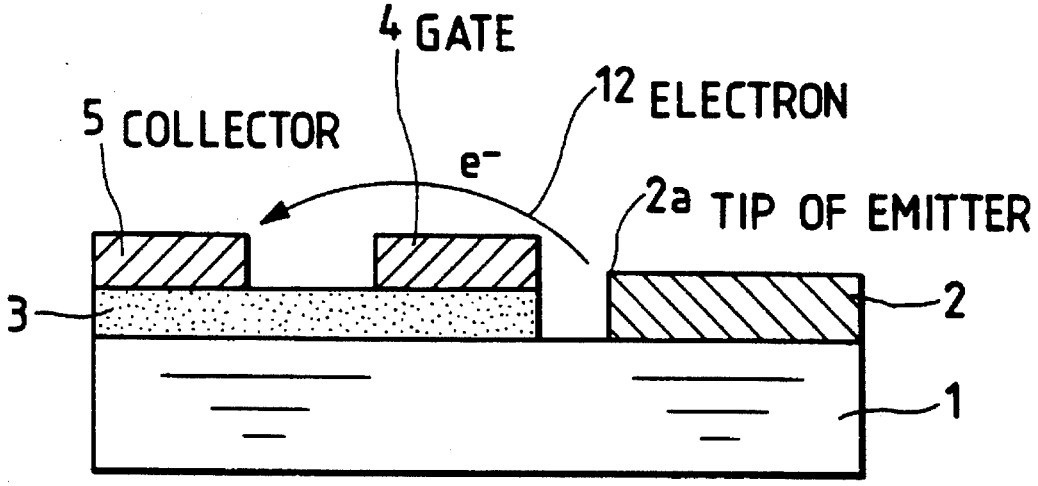

At first, as shown in FIG. 3A, an emitter material layer 13 made of Mo, Ta, W, ZrC, and $LaB_6$, etc. is formed to form the emitter 2 by spatter deposition, or electron beam deposition, etc. on the substrate 1 made of glass, or ceramics, etc. with its thickness having 300 nanometer to 1 micrometer. Then, a resist 14 is formed with its thickness having 1 to 2 micrometers to have a given pattern on the emitter material layer 13 using the photolithography technique. Then, as shown in FIG. 3B, etching processing is performed to the emitter material layer 13 to have the wedge-shaped emitter 2. At this point, as shown in FIG. 3B, the emitter 2 is so processed that its size is smaller than that of the resist 14 by 1 micrometer by selecting the condition that under-etching occurs. Then, as shown in FIG. 3C, the insulating layer 3 made of $Sio_2$, $Si_3N_4$, $Ta_2O_5$, etc. and the conducting layer 15 made of Mo, Ta, Cr, Al, Au, etc. are formed by spatter deposition, electron beam deposition, or CVD, etc. on the substrate 1 and the resist 14 with their thicknesses having 300 nanometers to one micrometer and 200 to 500 nanometers respectively. Then, as shown in FIG. 3D, the resist 14 is lifted off together with the insulation layer 3 and the conductive layer 15 on the resist 14. Then, the resist 16 is formed with a given pattern again. Then, as shown in FIG. 3E, the conductive layer 15 is etched using the resist 16 as a mask and then the resist 16 is removed, so that the gate 4 and the collector 5 are formed. In FIG. 3E, the emitter 2 has the wedge-shape with a sharp tip 2*a* at its right hand of the drawing.

Then, a voltage of 100 to 300 volts is applied between the collector 5 and the emitter 2 and a triangle waveform voltage of 0 to 70 volts is applied between the emitter 2 and the gate 4. Then, emission of electrons 12 occurs when the applied voltage is more than 50 V, so that the emitted electrons 12 flow into the collector 5. That is, a collector current can be suitably controlled in accordance with the voltage change of the gate 4.

Figure 4:
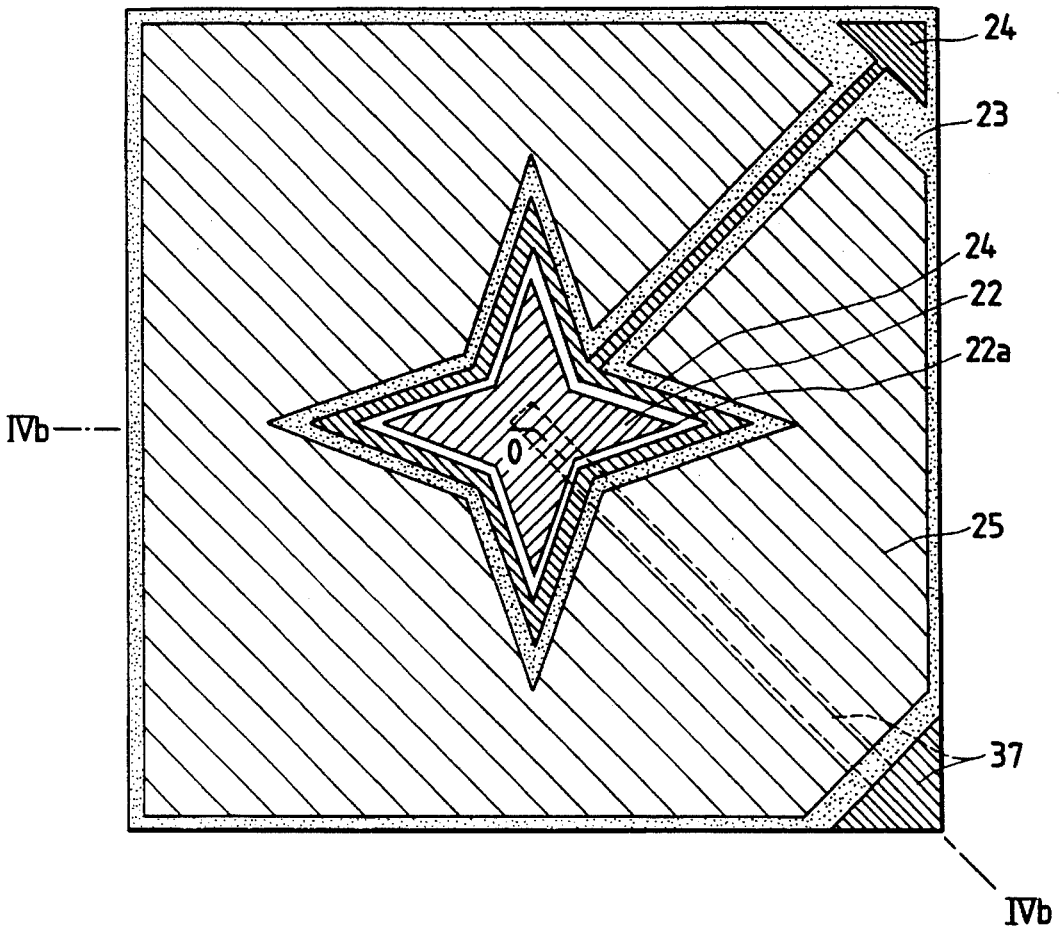
FIG. 4 is a plan view of a second embodiment of the invention of a functional vacuum microelectronic field-emission device.
Figure 5:
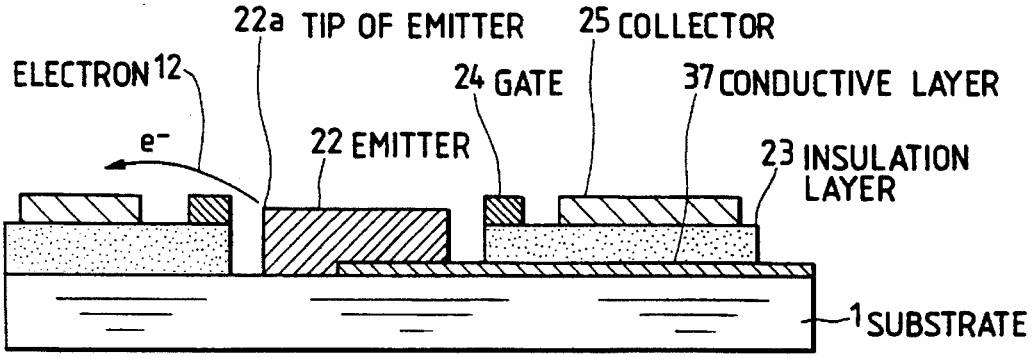
FIG. 5 shows a cross section taken on line IVb—IVb shown in FIG. 4.

Then, a second embodiment of the invention will be described. FIG. 4 is a plan view of the second embodiment of the invention of a functional vacuum microelectronic field-emission device. FIG. 5 shows a cross section taken on line IVb—IVb shown in FIG. 4.

As shown in FIGS. 4 and 5, a conductive layer 37 is made of Mo, Ta, Cr, Al, Au, etc. is formed on the substrate 1 made of glass, or ceramics, etc. The conductive layer 37 has a given shape, for example, a shape such that it extends from a peripheral point toward a center of the substrate 1 to provide electrical connection to the center portion of the substrate 1. An emitter 22 made of a material having a low work function such as Mo, Ta, W, ZrC, $LAB_6$, etc. is formed such that the conducting layer 37 provides electrical connection to the emitter 22. A width of at least a portion of the emitter 2 successively decreases linearly substantially, so that a tip 22*a* is formed-sharply. That is, the emitter is formed to have a wedge portion. In the example shown in drawings, the emitter 22 has a cross-shape such that four projecting portions extend toward four different directions from its center respectively. A width of each projecting portion successively decreases linearly with distance from the center to tip of each projecting portion, so that each tip 22*a* is formed sharp. On the substrate 1 and the conductive layer 37, an insulation layer 23 made of $SiO_2$, $Si_3N_4$, $Al_2O_3$, $Ta_2O_5$, etc. is formed a given interval apart from the wedge portion of the emitter 2 such that the insulation layer 23 encloses the emitter 22. An end of the conductive layer 37 at the peripheral portion of the substrate 37 is exposed to function as a lead terminal. On the insulation layer 23, a gate 24 made of Mo, Ta, Cr, Al, Au, etc. is formed. A portion of the gate 24 extends to another peripheral portion of the substrate in a direction different from that of the conductive layer 37 to have a lead terminal. On the insulation layer 23, a collector 25 made of Mo, Ta, Cr, Al, Au, etc. is formed a given interval apart from the gate 24 at circumference of the gate 24 on the opposite side of the gate 24 from said emitter 22. The conductive layer 37 is used as a lead electrode for providing electrical connection to the emitter 22. Electrons 12 are emitted from the tips 22*a* of the emitter 22.

Because operation of this embodiment is the same as that of the above-mentioned first embodiment, the description of operation is omitted.

An example of production processing of the functional vacuum microelectronic field-emission device of the above-mentioned second embodiment will be described with reference to cross-sectional views of FIGS. 7A to 7H. FIGS. 7A–7H show cross sections for showing an example of production processing of the functional vacuum microelectronic field-emission device of the second embodiment.

Figure 7A:
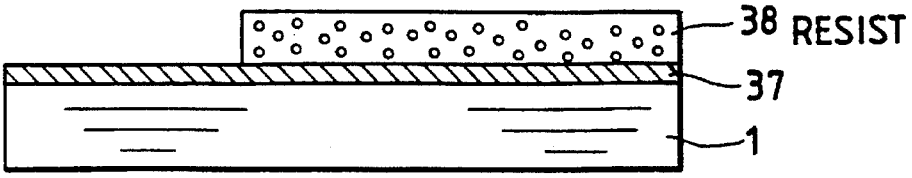
FIGS. 7A–7H show cross sections for showing an example of production processing of the functional vacuum microelectronic field-emission device of the second embodiment.
Figure 7B:
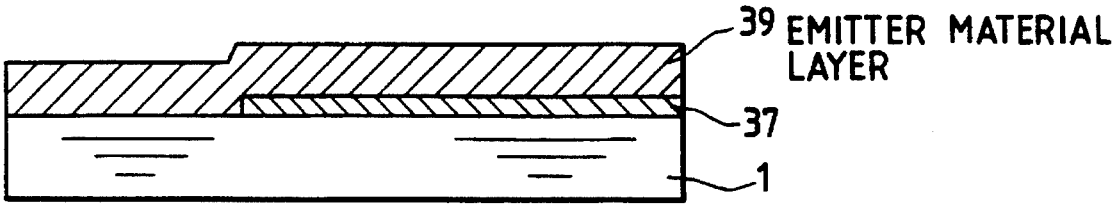
Figure 7C:
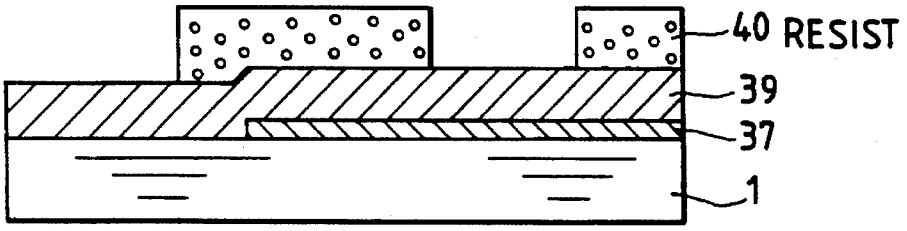
Figure 7D:
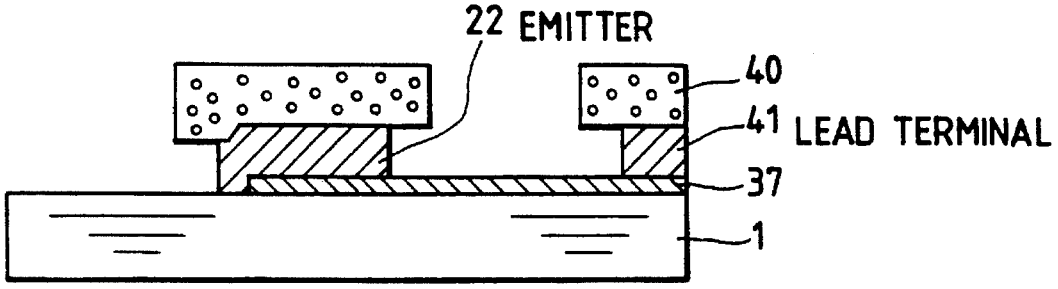
Figure 7E:
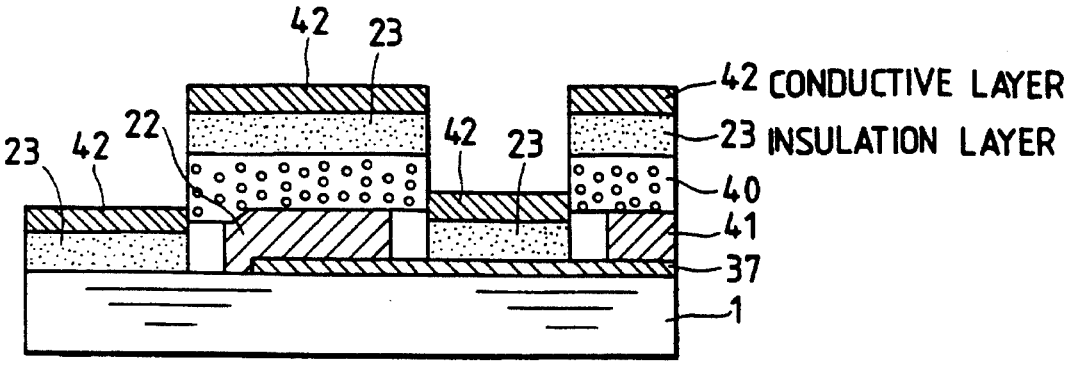
Figure 7F:
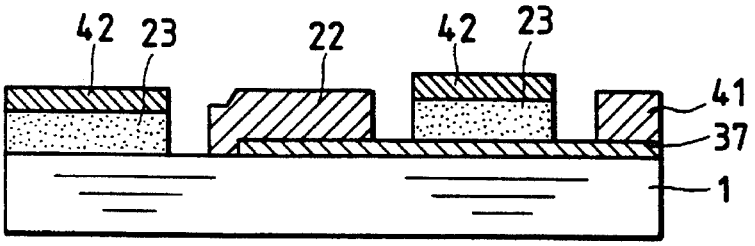
Figure 7G:
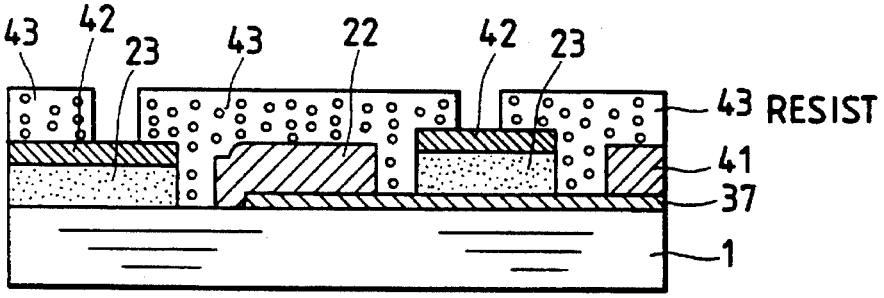
Figure 7H:
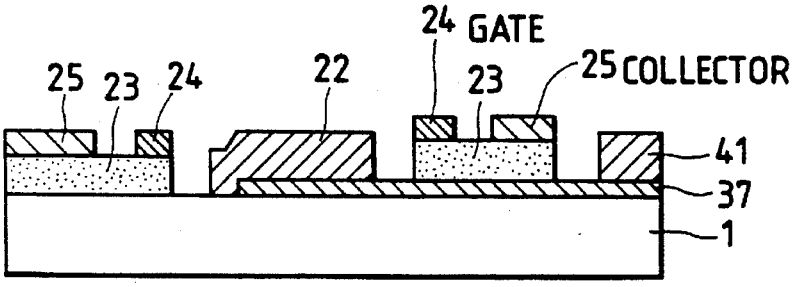

At first, as shown in FIG. 7A, on the substrate 1 made of glass, or ceramics, etc. the conductive layer 37 made of Mo, Ta, Cr, Al, Au, etc. is formed by the spatter deposition, or the electron beam deposition, etc. on the substrate 1 with its thickness having 200 nanometers to 300 nanometers. Then, a resist 38 is formed. Then, as shown in FIG. 7B, etching processing is performed to partially remove the conductive layer 37 using the resist 18 as a mask. Then, an emitter material 39 made of Mo, Ta, Cr, Al, Au, etc. is formed by the spatter deposition, the electron beam deposition, or the CVD, etc. with its thicknesses having 300 nanometers to one micrometers. Then, as shown in FIG. 7C, a resist 40 having a given pattern on the emitter material layer 39 with its thickness of 1–2 micrometers. Then, as shown in FIG. 7D, the emitter material layer 39 is etched to form the emitter 22 and a lead terminal 41, the emitter 22 having four projecting portions, each of projecting portions having an wedge shape (in FIG. 4, the lead terminal 41 is not provided). At this point, the emitter material layer 39 is so processed that its peripheral portion is smaller than the resist 40 by up to 1 micrometer by over-etching the emitter material 39. Then, as shown in FIG. 7E, the insulating layer 23 made of $Sio_2$, $Si_3N_4$, $Ta_2O_5$, etc. and the conducting layer 42 made of Mo, Ta, Cr, Al, Au, etc. are formed by the spatter deposition, the electron beam deposition, or the CVD, etc. and the resist 20 with their thicknesses having 300 nanometers to one micrometers and 200 to 500 nanometers respectively. Then, as shown in FIG. 7F, the resist 40 is lifted off together with the insulation layer 23 and the conductive layer 42 formed on the resist 40. Then, the resist 23 is formed with a given pattern again as shown in FIG. 4F. Then, as shown in FIG. 7G, the conductive layer 42 is etched using the resist 23 as a mask to remove the resist 21, so that the gate 24 and the collector 25 is formed.

Figure 6:
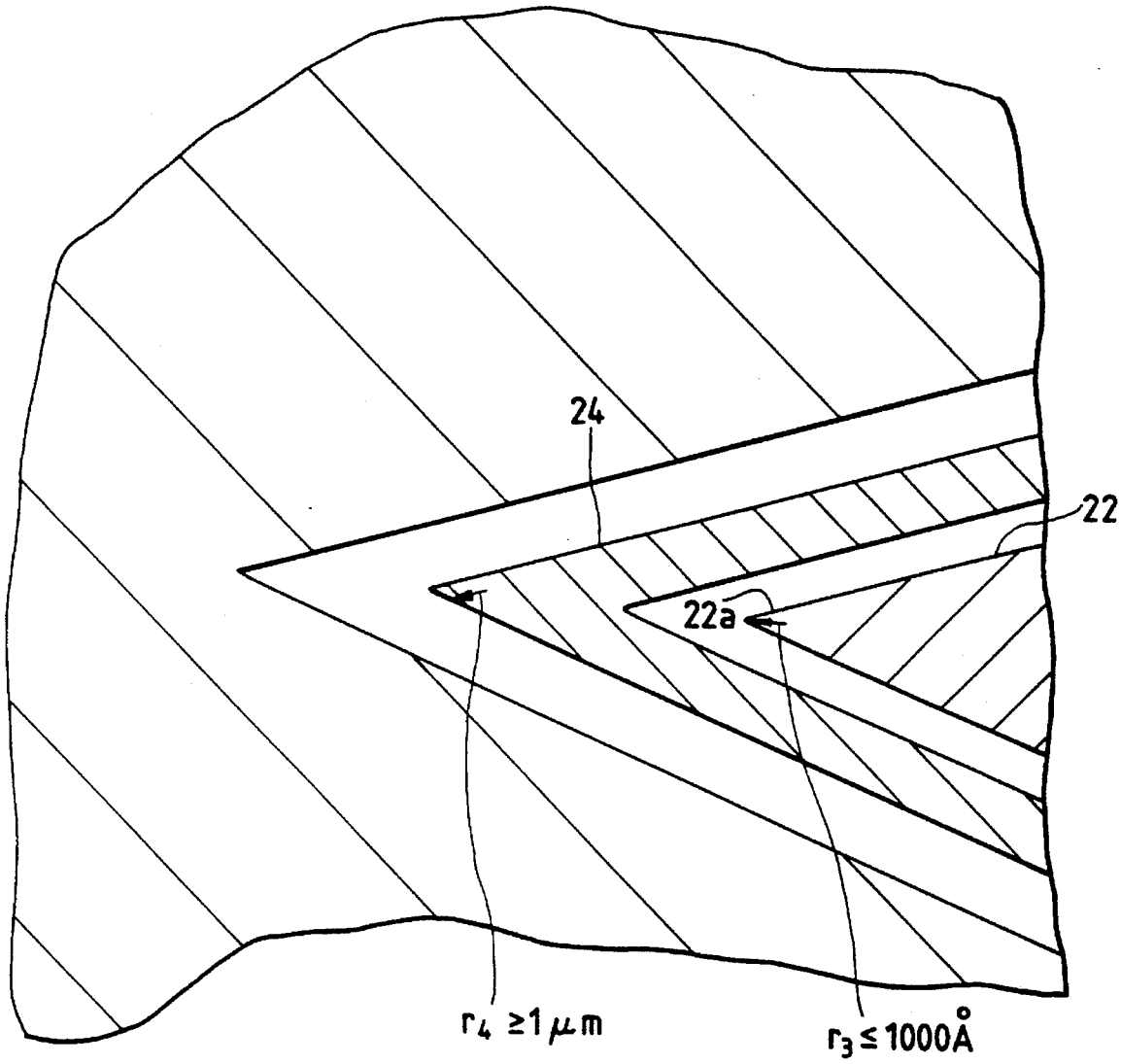
FIG. 6 is an enlarged plan view of the functional vacuum microelectronic device of the second embodiment partially shown.

FIG. 6 is an enlarged plan view of the functional vacuum microelectronic field-emission device of the second embodiment partially shown. The tip 22*a* is formed to have a radii r3 of the tip 22*a* which is equal to or less than 1000 angstroms. This concentrates lines of electric force at the tip 22*a*. On the other hand, The tip of the projected portion of the gate 24 is formed to have a radii r4 thereof which is equal to or larger than 1 micrometer.

In the functional vacuum microelectronic field-emission device, the control of a current of the collector 5 can be carried out readily in accordance with the voltage change of the gate 24 similar to the above-mentioned first embodiment.

Hereinbelow will be described a third embodiment of the invention.

Figure 8:
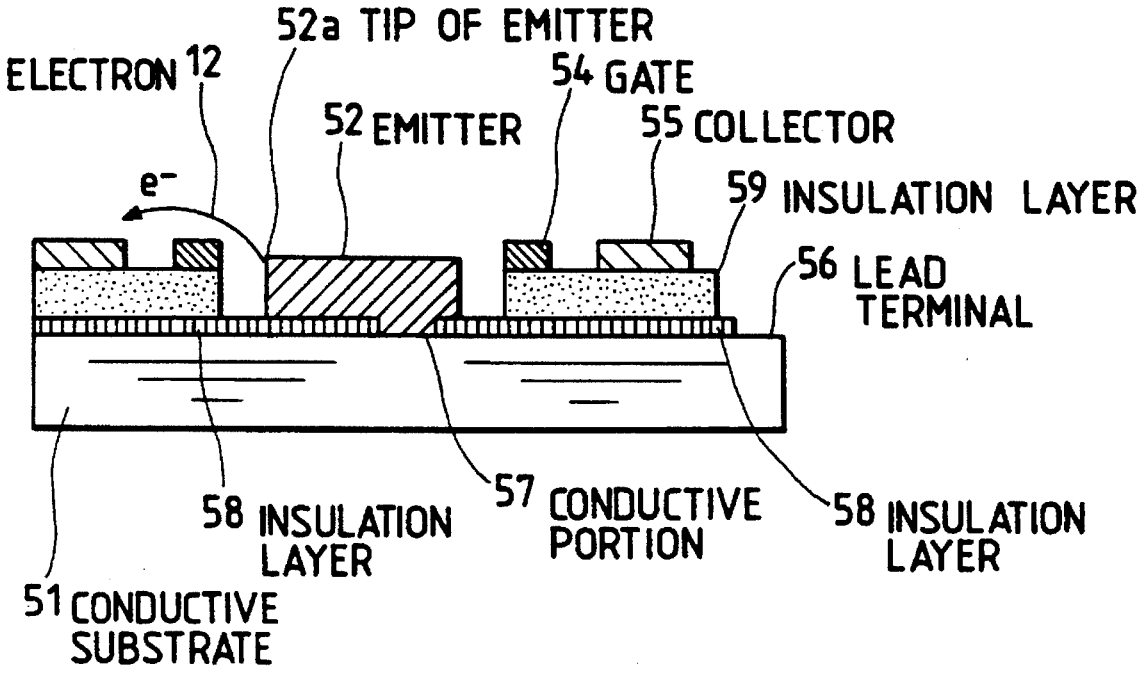
FIG. 8 shows a cross section of a functional vacuum microelectronic field-emission device of a third embodiment of the invention.

FIG. 8 shows a cross section of a functional vacuum microelectronic field-emission device of the third embodiment of the invention.

As shown in FIG. 8, an insulating layer 58 made of $Sio_2$, $Si_3N_4$, $Ta_2O_5$, etc. is formed on a conductive substrate 51 made of Mo, Ta, Cr, Al, Au, etc. The insulation layer 58 has a shape such that portions of the conductive substrate 51 are exposed at a conducting portion 57 and at a lead terminal portion 56 provided at the peripheral portion of the conductive substrate 51. On the conducting portion 57 and insulation layer 58 of the substrate 51, an emitter 52 is formed which is similar to that of the above-mentioned second embodiment and is electrically connected to the substrate 1 at the conducting portion. Because structure of the insulation layer 58, gate 54, collector 54, etc. and operation are the same as those of the above-mentioned second embodiment, the description is omitted.

As mentioned above, according to this invention, application of a voltage between the emitter and the gate and the input of a voltage from the signal input portion causes emitting electrons from the emitter in accordance with the combined voltage. Application of a voltage to the collector can take the emitted electrons so that a voltage at the output terminal of the collector portion can be changed. Moreover, operation voltage can be decreased and the amount of the emitted electrons can be increased because the material whose work function is low can be used as the emitter. Therefore, an output level of the collector is increased, so that S/N ratio is improved. Further, it can be produced by the deposition technique and a simple lithography technique, so that yield and reliability is improved.

Hereinbelow will be described a fourth embodiment of this invention with reference to drawings.

Figure 9:
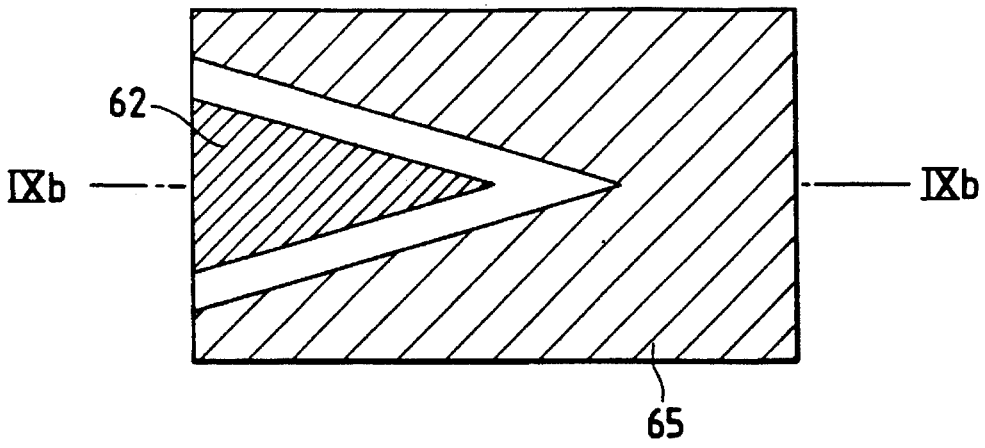
FIG. 9 is a plan view of a fourth embodiment of a functional vacuum microelectronic field-emission device of this invention.
Figure 10:
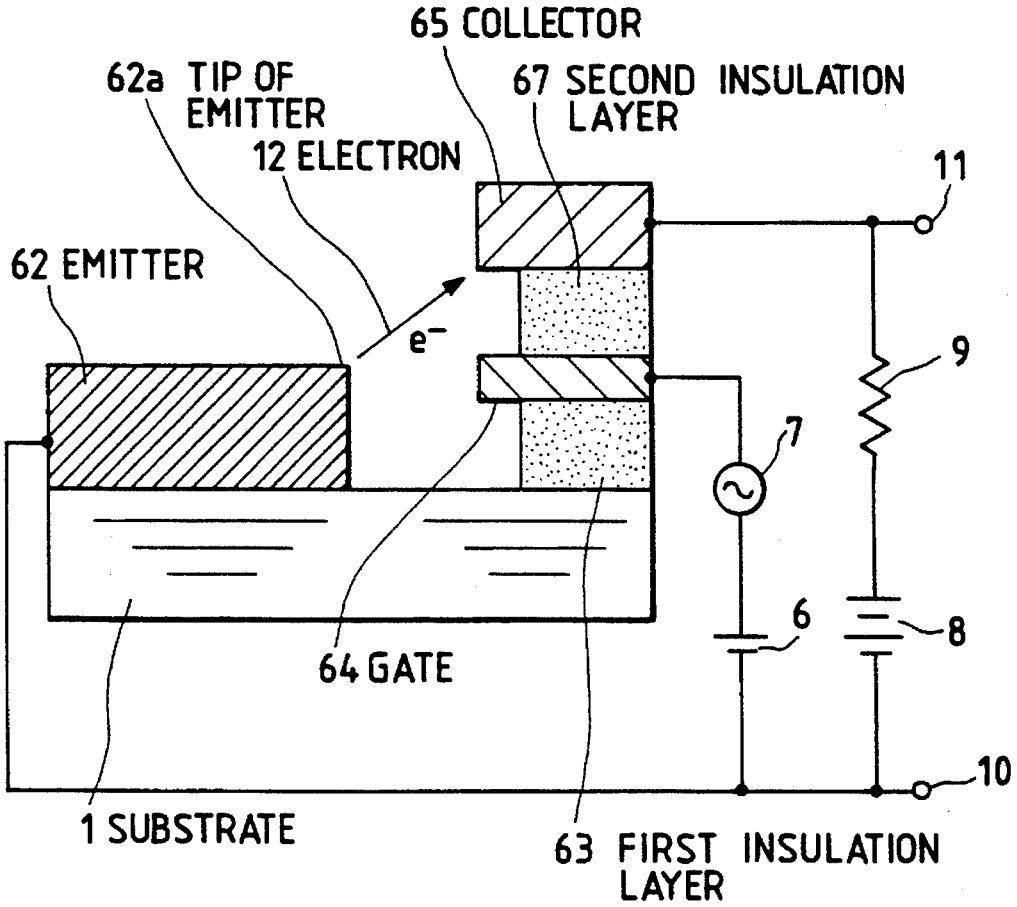
FIG. 10 shows a cross section taken on line IXb—IXb shown in FIG. 9.

FIG. 9 is a plan view of the fourth embodiment of a functional vacuum microelectronic field-emission device of this invention. FIG. 10 shows a cross section taken on line IXb—IXb shown in FIG. 9.

As shown in FIGS. 9 and 10, an emitter 62 is formed on an insulation substrate 1 made of glass, ceramic, etc. (a metallic substrate can be used also). The emitter 62 is made of a material having a low work function such as Mo, Ta, W, ZrC, $LaB_6$, etc. A width of at least a portion of the emitter successively changes lineally, so that a tip 62*a* is formed sharply. That is, the emitter is formed to have an wedge portion. On the substrate 1, a first insulation layer 63 made of $SiO_2$, $Si_3N_4$, $Al_2O_3$, $Ta_2O_5$, etc. is formed a given interval apart from the wedge portion of the emitter 62. On the first insulating layer 63, a gate 64 made of Mo, Ta, Cr, Al, or Au, etc. is formed a given interval apart from the wedge portion on the outside of the wedge portion of emitter 62. On the gate 64, a second insulation layer 67 made of $SiO_2$, $Si_3N_4$, $Al_2O_3$, $Ta_2O_5$, etc. is formed. On the second insulation layer 67, a collector 65 made of $SiO_2$, $Si_3N_4$, $Al_2O_3$, $Ta_2O_5$, etc. is formed. The bias power source 7 and the signal input portion 8 are connected between the gate 64 and the emitter 62. The collector power source 9 and the resistor 10 are connected between the emitter 62 and collector 65.

Hereinbelow will be described operation in the above-mentioned structure.

For example, as shown in FIG. 10, the bias power supply 6, the signal input portion 7, the collector power supply 8, and the resistor 9 are connected. A suitable bias voltage is applied between the emitter 62 and gate 64 by the bias power supply 6. Then, a suitable voltage is inputted from the signal input portion 7. Thus, the voltage between the emitter 62 and the gate 64 is a combined voltage of the bias voltage and the input signal voltage, so that an electric field whose intensity determined in accordance with the combined voltage. At this point, electric fields at respective surfaces of the emitter 62 are determined by geometric position relations between the gate 64 and the respective surfaces of the emitter 62. As a result of a simulation analyzing, it has been known that lines of electric force are concentrated at the sharp tip **62*a* of the wedge portion of the emitter 62, that is, an electric field at the tip 62*a* is strong. Electron emission caused by electric fields at respect points of the emitter 62, which are determined in accordance with the combined voltage. In the wedge-shaped emitter 62, almost all of electrons 12 can be emitted from the tip portion 62*a* of the emitter 62 because the electric fields is strong at the tip portion 2*a* as mentioned above. In this state, electrons 12 emitted into the vacuum space can be taken into the collector 65 by application of a sufficient positive voltage to the collector power supply 8. Accordingly, a current flows through the resistor 9, so that a voltage change can be obtained from the terminal 11. That is, an output can be obtained as a change in the output voltage from the output terminal 11 of the collector 66 in accordance with a voltage change of the signal input portion 7. Moreover, it is possible that a material having a low work function is selected as the material of the emitter 2** because anisotropic etching is not carried out. Therefore, the signal output level can be increased and S/N ratio is improved. Therefore, the signal output level can be increased and S/N ratio is improved.

Then, an example of production processing of the functional vacuum microelectronic field-emission device of the above-mentioned fourth embodiment will be described with reference to FIGS. 11A to 11D. FIGS. 11A–11D show cross sections for showing an example of production processing of the functional vacuum microelectronic field-emission device of the fourth embodiment.

Figure 11A:
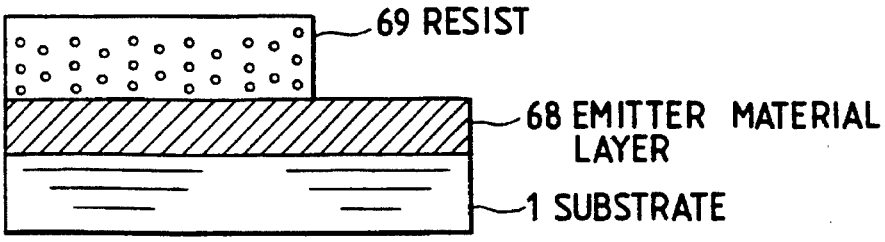
FIGS. 11A–11D show cross sections for showing an example of production processing of the functional vacuum microelectronic field-emission device of the fourth embodiment.
Figure 11B:
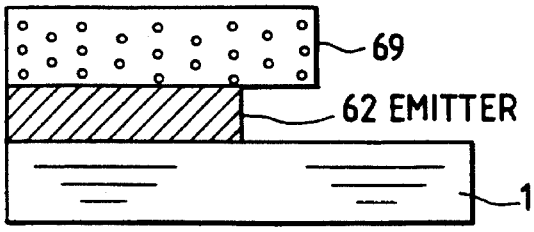
Figure 11C:
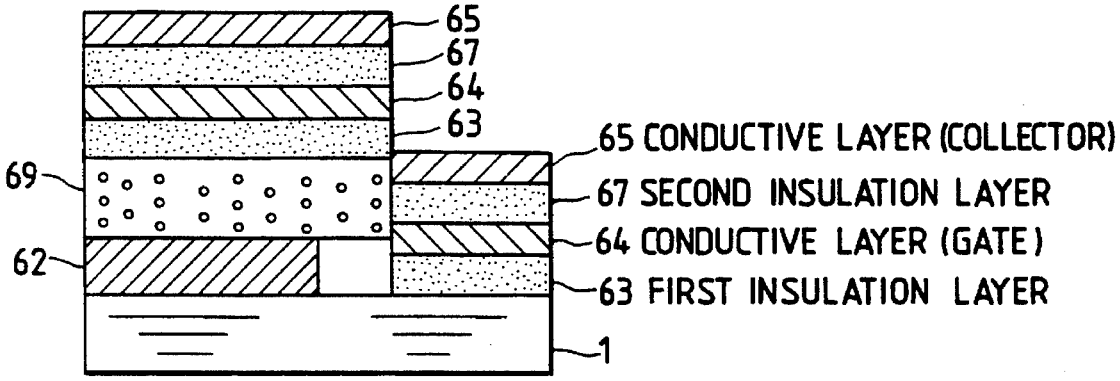
Figure 11D:
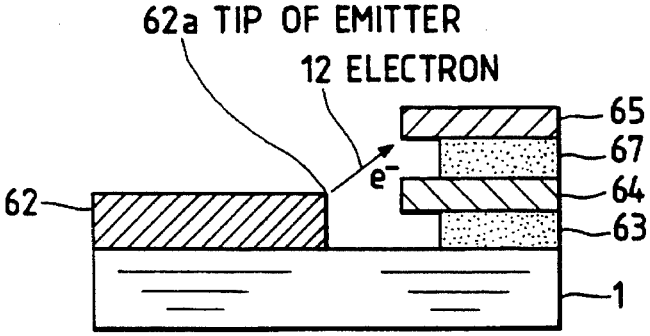

As shown in FIG. 11A, an emitter material layer 68 made of Mo, Ta, W, ZrC, and $LaB_6$, etc. is formed to provide the emitter 62 by the spatter deposition, or the electron beam deposition, etc. on the substrate 1 made of glass, or ceramics, etc. with its thickness having 300 nanometer to 1 micrometer. Then, a resist 69 is formed with its thickness having 1 to 2 micrometers to have a given pattern on the emitter material layer 68 using the photolithography technique. Then, as shown in FIG. 11B, etching processing is performed to the emitter material layer 68 to have the wedge-shaped emitter 62. At this point, the emitter 62 is so processed that its peripheral portion is smaller than the resist 69 by up to 1 micrometer by selecting the condition that under-etching occurs. Then, as shown in FIG. 11C, the first insulating layer 63 made of $Sio_2$, $Si_3N_4$, $Ta_2O_5$, etc. and a conducting layer made of Mo, Ta, Cr, Al, Au, etc., as the gate 64, a second insulation layer 67 made of the similar material to that mentioned above and a conductive layer made of the similar material to that mentioned above which is to be collector 65 are successively formed by the spatter deposition, the electron beam deposition, or the CVD, etc. on the substrate 1 and the resist 69 with their thicknesses having 300 nanometers to one micrometers, 200 to 500 nanometers, 500 nanometers to one micrometers, and 300 to 500 nanometer respectively. Then, as shown in FIG. 11D, the resist 69 is lifted off together with the insulation layer 63, the conductive layer 64, the second insulation layer 67, and the conductive layer 65 formed on the resist 14. Then, the first and second insulation layers 63 and 67 are finally formed into the gate 64 and the collector 65 by side-etching. In FIG. 11D, the emitter 2 has an wedge shape with tip **2*a* thereof at its right hand as shown in FIG. 9**.

Then, a voltage of 100 to 300 volts is applied to the collector 65 and a triangle waveform voltage of 0 to 70 volts is applied between the emitter 62 and the gate 64. Then, emission of electrons 12 occurs when the applied voltage is more than 50 V, so that the emitted electrons 12 flow into the collector 65. That is, the collector current can be suitably controlled in accordance with the voltage change of the gate 64.

Figure 12:
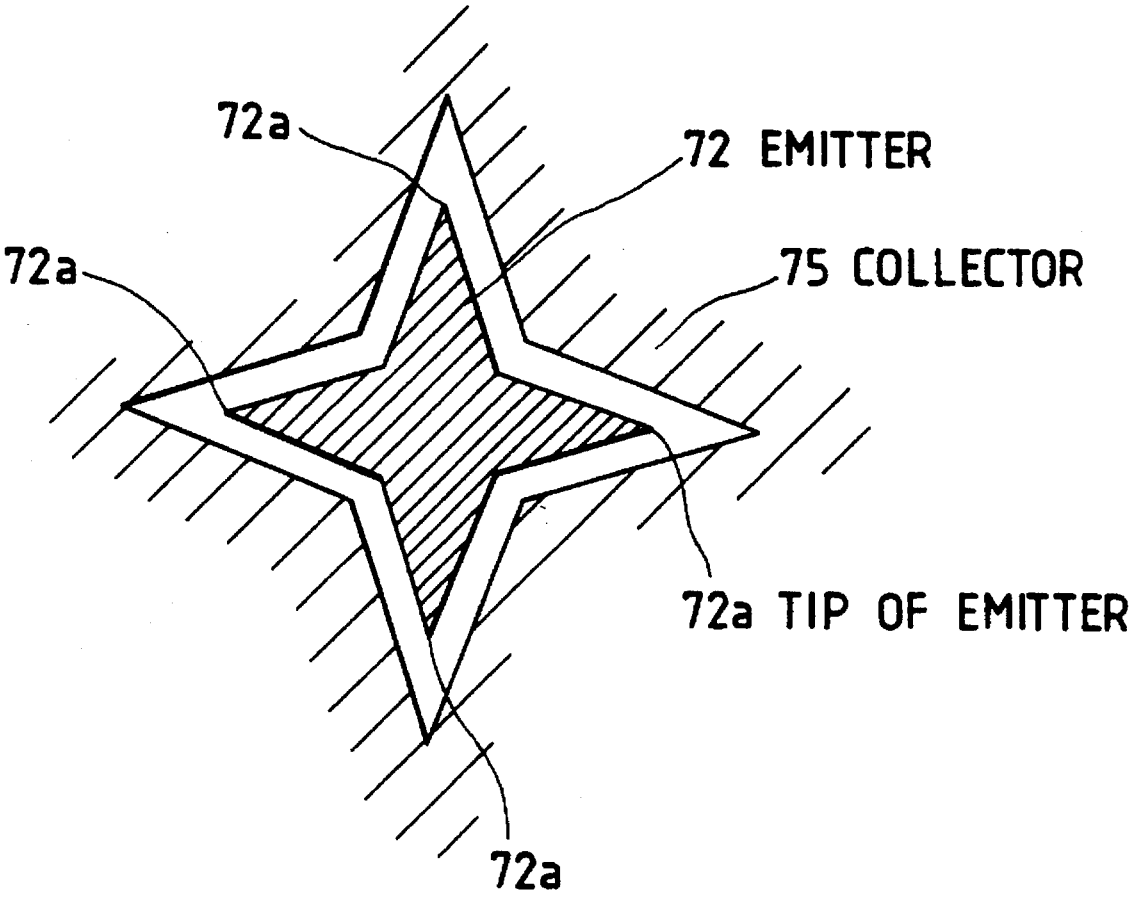
FIG. 12 is a plan view partially showing a functional vacuum microelectronic field-emission device of a fifth embodiment.

Then, a fifth embodiment of the invention will be described. FIG. 12 is a plan view partially showing the functional vacuum microelectronic field-emission device of the fifth embodiment of the invention.

In this embodiment, as shown in FIG. 12, the emitter 72 is formed to have a cross-shape such that four projecting portions extend in four different directions from its center respectively. A with of each of projecting portions **72*a* successively is decreased substantially linearly with distance from the center to a tip 72*a* of each of projecting portions, so that each tip 72*a* is formed sharp. The first insulation layer 63 (not shown In FIG. 12, gate 64 (not shown in FIG. 12), the second insulation layer 67 (not shown in FIG. 12), and the collector 75 are formed such that they enclose the emitter 62**. Other structure and operation are the same as that of the above-mentioned first embodiment.

As mentioned above, according to this invention, application of a voltage between the emitter portion and the gate portion and input of a voltage from the signal input portion cause emitting electrons from the emitter portion in accordance with the combined voltage and application of a voltage to the collector portion can take electrons emitted so that a voltage at the output terminal of the collector portion can be changed. Moreover, operation voltage can be decreased and the amount of electron emitted can be increased because the material whose work function is low can be used as the emitter portion. Therefore, an output level of the collector portion is increased, so that S/N ratio is improved. Further, it can be produced by the deposition technique and a simple lithography technique, so that yield and reliability is improved.

Hereinbelow will be described a sixth embodiment with reference to drawings.

Figure 13:
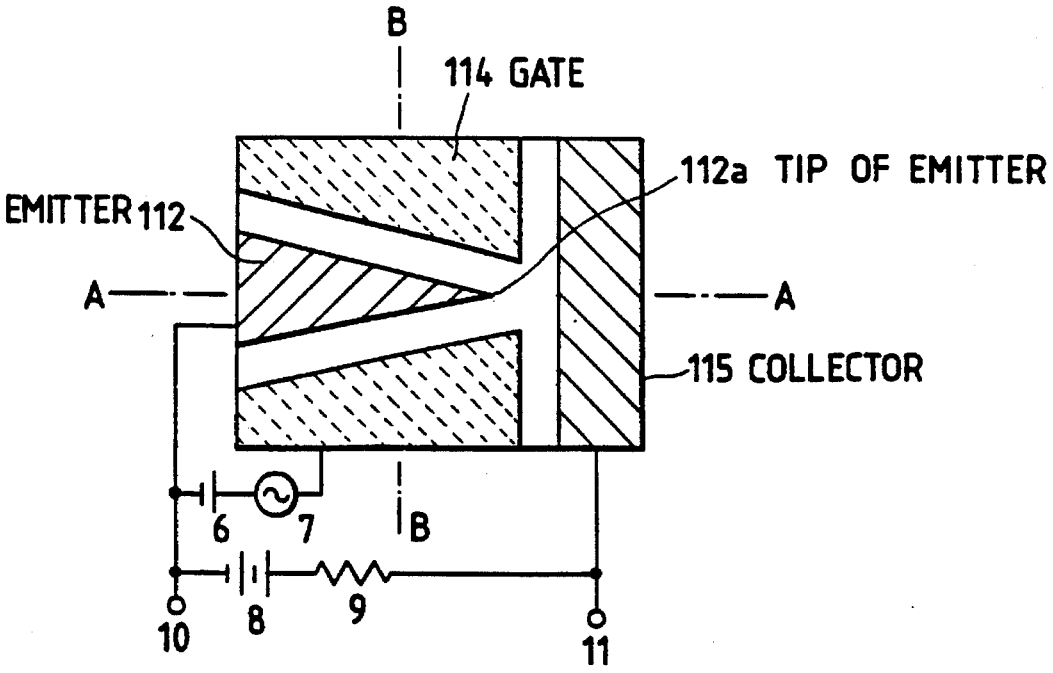
FIG. 13 is a plan view of a functional vacuum microelectronic field-emission device of a sixth embodiment of the invention.
Figure 14:
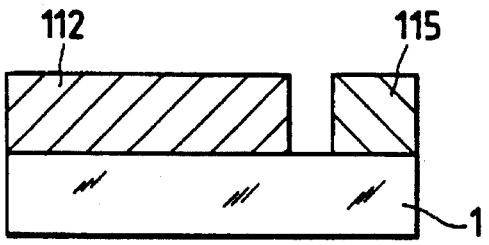
FIG. 14 shows a cross section taken on line A—A shown in FIG. 13.
Figure 15:
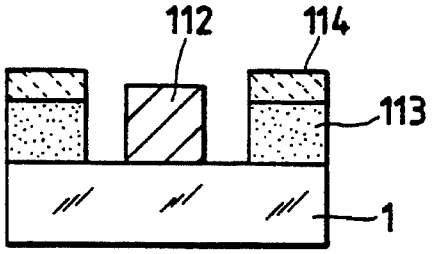
FIG. 15 shows a cross section taken on line B—B shown in FIG. 13.

FIG. 13 is a plan view of a functional vacuum microelectronic field-emission device of the sixth embodiment of the invention. FIG. 14 shows a cross section taken on line A—A shown in FIG. 13. Fig. 15 shows a cross section taken on line B—B shown in FIG. 13. Numeral 1 is a substrate, numeral 112 is an emitter, numeral 114 is a gate, numeral 113 is an insulation layer, numeral 6 is a bias power supply, numeral 7 is a signal input portion, numeral 8 is a collector power supply, numeral 9 is a resistor, numerals 10 and 11 are terminals, and numeral 112*a* is a tip of the emitter.

The emitter 112 is formed on an insulation substrate 1 made of glass, ceramic, etc. The emitter 112 is made of a material, such as Mo, Ta, W, ZrC, or $LaB_6$, etc. It is formed to have a wedge portion such that a width of at least a portion of the emitter 112 successively changes. A collector 115 made of Mo, Ta, Cr, Al, or Au, etc. is formed a given interval apart from a tip portion 112*a* of the wedge-shaped emitter 112. An insulation layer 113 made of $SiO_2$, $Si_3N_4$, $Al_2O_3$, $Ta_2O_5$, etc. is formed a given interval apart from the emitter 112 and the collector 115. The insulation layer 113 is provided for adjusting a height of gate 114 to control emission of electrons. The gate 114 made of Mo, Ta, Cr, Al, or Au, is formed on a given portion of the insulation layer 113.

Hereinbelow will be described operation of the functional vacuum microelectronic field-emission device of the sixth embodiment. For example, the bias power supply 6 and the signal input portion 7 are connected between the emitter 112 and gate 114, and an collector power supply 8 and a resistor 9 are connected between the emitter 112 and collector 115 as shown in FIG. 13. A suitable bias potential is applied between the emitter 112 and the gate 114 by the bias power supply 6. When a suitable voltage is applied by the signal input portion 7, a voltage between the emitter 112 and the gate 114 is determined by a sum of the bias voltage and the input signal voltage, namely a combined voltage. Therefore, an electric field whose intensity is determined in accordance with the combined voltage is applied to the emitter 112. Electric fields at each point on the surface of the emitter is determined by a combined electric field determined by geometric positions relation between respective points of the surface of the gate 114. As a result of simulation analysis, it is known that lines of electric force at the wedge-shaped emitter 112 most concentrate at the tip portion 112*a* and its intensity of the electric field is strong. Emission of electrons occurs in accordance with electric fields at respect portions of the emitter 112 determined by the combined voltage and as mentioned above. Because lines of electric force concentrates at the tip portion 112 of the emitter particularly, it is possible to emit almost all electrons from the tip portion 112*a* of the emitter 112. Moreover, electrons emitted to the vacuum space can be taken into the collector 115 by application of a sufficient positive voltage by the collector power supply 8. As the result, a current flows through the resistor 9, so that a change in voltage between the terminals 10 and 11. That is, a change in the output voltage can be obtain from the output terminal 11 of the collector 114 in accordance with a voltage change of the signal input portion 7.

Hereinbelow will be described a seventh embodiment of the invention with reference to drawings.

Figure 16:
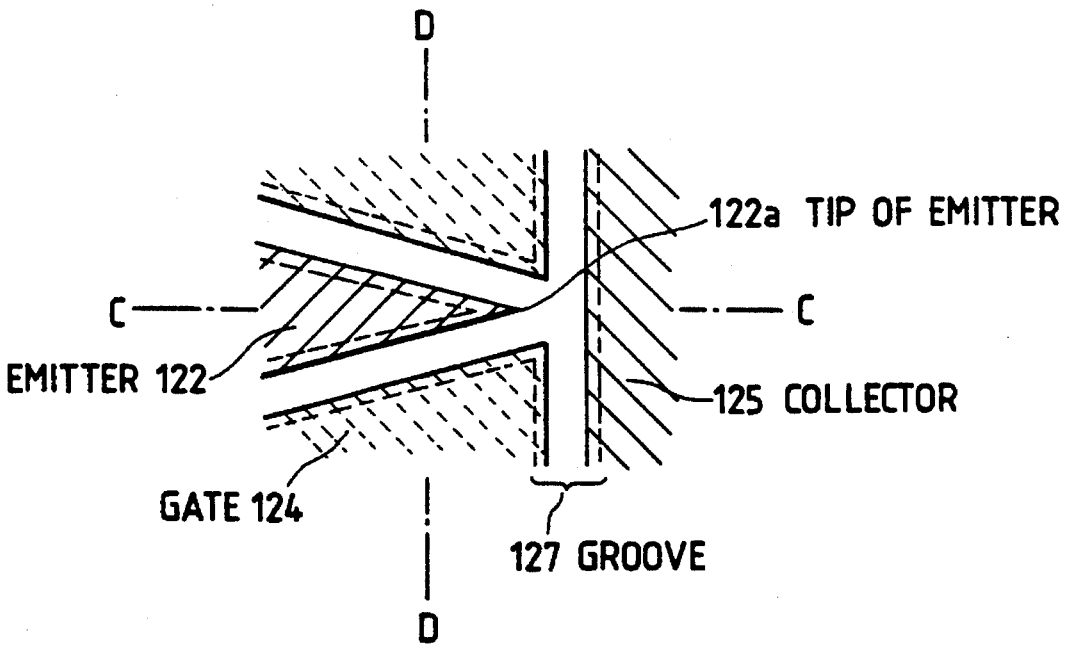
FIG. 16 is a plan view of a seventh embodiment of a functional vacuum microelectronic field-emission device of the invention.
Figure 17:
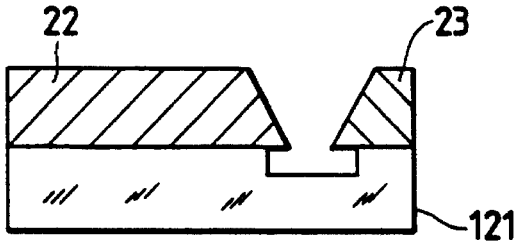
FIG. 17 shows a cross section taken on line C—C shown in FIG. 16.
Figure 18:
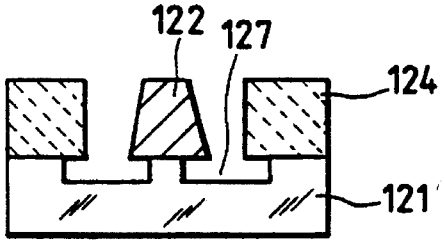
FIG. 18 shows a cross section taken on line D—D shown in FIG. 16.

FIG. 16 is a plan view of the seventh embodiment of a functional vacuum microelectronic field-emission device of the invention. FIG. 17 shows a cross section taken on line C—C shown in FIG. 16. FIG. 18 shows a cross section taken on line D—D shown in FIG. 16. Numeral 121 is a substrate, numeral 22 is an emitter, numeral 125 is a collector, numeral 124 is a gate, numeral 127 is a groove, and numeral 122*a* is a tip portion of the emitter 122.

The emitter 122 is formed on an insulation substrate 121 made of glass, ceramic, etc. The emitter 112 is made of a material, such as Mo, Ta, W, ZrC, or $LaB_6$, etc. The emitter is formed to have a wedge portion such that a width of at least a portion of the emitter 122 successively changes. A collector 125 made of Mo, Ta, Cr, Al, or Au, etc. is formed a given interval apart from a tip portion 122*a* of the wedge-shaped emitter 122. The collector made of Mo, Ta, Cr, Al, or Au, etc. is formed a given interval apart from the tip 122*a* of the wedge-shaped emitter 122. Moreover, a gate 124 made of Mo, Ta, Cr, Al, or Au, etc. is formed a given interval apart from the emitter 122 and the collector 125 at a given portion. At least a surface portion of the substrate 21, where the emitter 122, collector 125, and gate 124 are not formed, and its neighborhood portions are removed to have a groove 127. The groove 127 prevents a leak current. Description of its operation is omitted because it is the same as that of the first embodiment.

Hereinbelow will be described an eighth embodiment of the invention with reference drawings. FIGS. 19A–19G show cross sections for showing an example of production processing of the functional vacuum microelectronic field-emission device of an eighth embodiment.

Figure 19A:
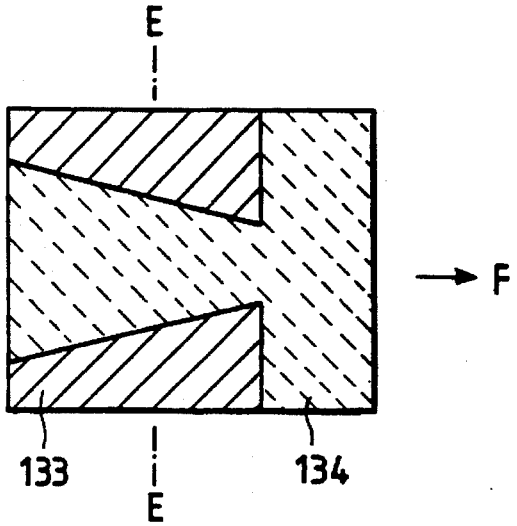
FIGS. 19A–19G show cross sections for showing an example of production processing of a functional vacuum microelectronic field-emission device of an eighth embodiment.
Figure 19B:
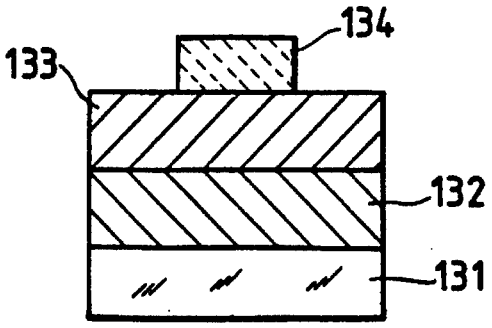
Figure 19C:
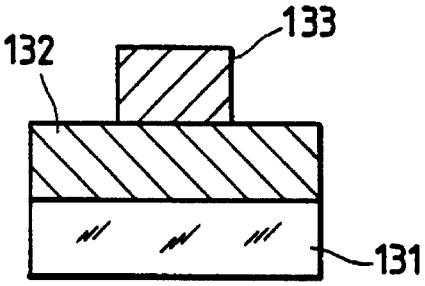
Figure 19D:
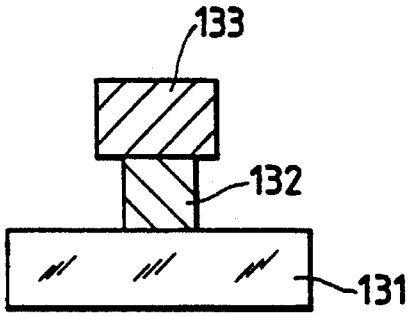
Figure 19E:
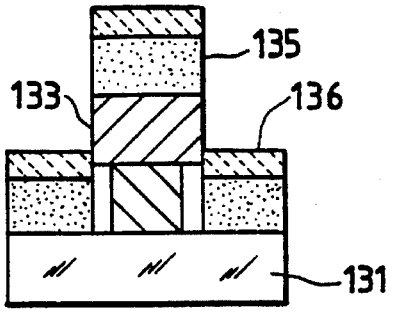
Figure 19F:
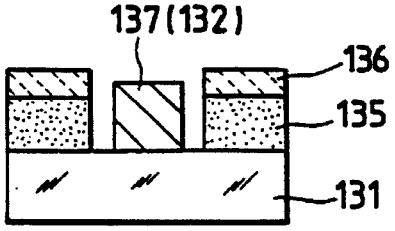
Figure 19G:
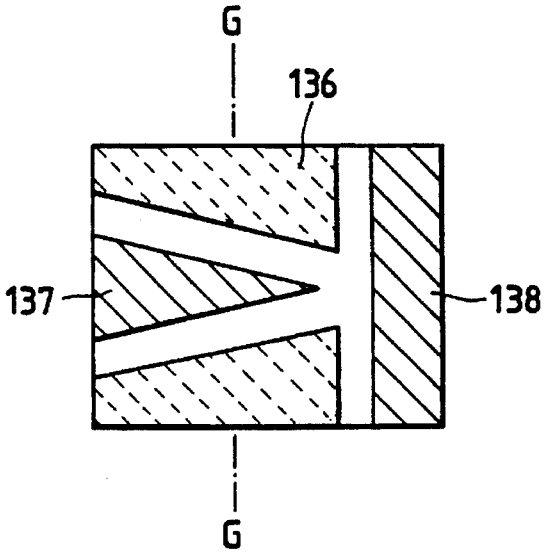

FIG. 19A is a plan view showing a first step of production processing of a functional vacuum microelectronic field-emission device of the eighth embodiment of the invention. FIG. 19B shows a cross section taken on line E—E shown in FIG. 19A. FIGS. 19C–19F are cross-sectional views showing successive processing steps. FIG. 19G is a plan view in a completion step. Numeral 131 is a substrate, numeral 132 is a conductive layer, numeral 133 is a coat layer, numeral 134 is a photoresist, numeral 135 is an insulation layer, numeral 136 is a gate electrode material, numeral 137 is an emitter, and numeral 138 is an collector.

At first, as shown in FIG. 19A and FIG. 19B, the conductive layer 132 made of Mo, Ta, W, ZrC, and $LAB_6$, etc. and the coat material 133 is formed successively by deposition, or the spatter deposition, etc. on the substrate 131 made of glass, or ceramics, etc. On the coat material 133, the photoresist 134 is formed by ordinal photolithography technique such that an width of at least a portion successively decreases in direction F and then, the width increases stepwise to an width of the substrate 131. Therefore, a constricted portion is made at a given portion of the photoresist 134. A metal or an insulation material can be used as the above-mentioned coating material. It may be a material capable of withstanding etching processing of the conductive layer 132 in a processing mentioned later and can be removed without corrosion of other materials. Then, as shown in FIG. 19C, the coating material 133 is etched using the photoresist 134 as a mask. Then, as shown in FIG. 19C, after removal of the photoresist 134, the conductive layer 132 is processed using the coating material 133 as a mask by wet-etching or dry-etching, etc. At this processing, the conductive layer 132 is side-etched to have a form whose size is smaller than pattern shape of the coating material 188 by a given length as shown in FIG. 19D. Thus, the emitter 137 is processed to have an wedge shape shown in FIG. 19G and the collector 138 is formed a given interval apart from the emitter 137. Then, as shown in FIG. 19E, on its surface, the insulation layer 135 made of $Sio_2$, $Si_3N_4$, $Ta_2O_5$, etc. and the gate electrode material 136 made of Mo, Ta, Cr, Al, Au, etc., are successively formed by deposition or the spatter, etc. Then, as shown in FIG. 19F, the coating material 133 is removed. This causes at the same time the insulation layer 135 and the gate electrode material 136 formed the coating material 133 are removed to expose the conductive layer 132. This condition is shown in FIG. 19G. As mentioned, the conductive layer 132 having the wedge-shape by etching processing is used as an emitter 137. The conductive layer 132 formed a given interval apart from the emitter 137 is used as the collector 138.

As mentioned, according to the production method of the functional vacuum microelectronic field-emission device of this embodiment, reproducibility in production is high and stability of the functional vacuum microelectronic field-emission device can be improved because positioning is not necessary because patterning of the resist is performed only once and the position relation between emitter 137 and gate 136 anti collector 138 which largely effects the characteristic of the functional vacuum microelectronic field-emission device can be controlled by side-etching width in etching processing and self-alignment is utilized.

Hereinbelow will be described a ninth embodiment of the invention with reference drawings. FIGS. 20A–20H show cross sections for showing an example of production processing of the functional vacuum microelectronic field-emission device of the ninth embodiment.

Figure 20A:
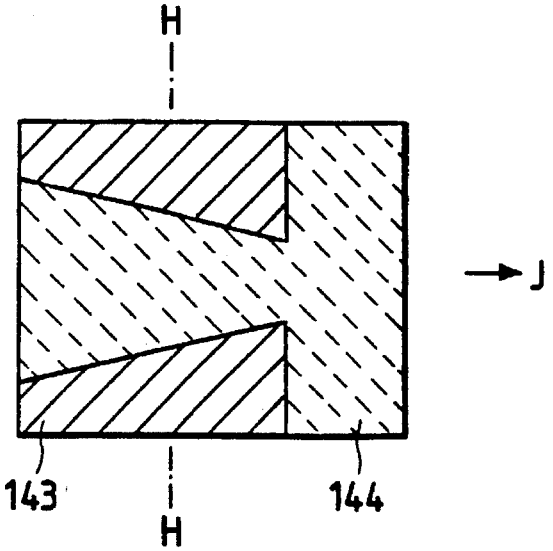
FIGS. 20A–20H show cross sections for showing an example of production processing of a functional vacuum microelectronic field-emission device of a ninth embodiment.
Figure 20B:
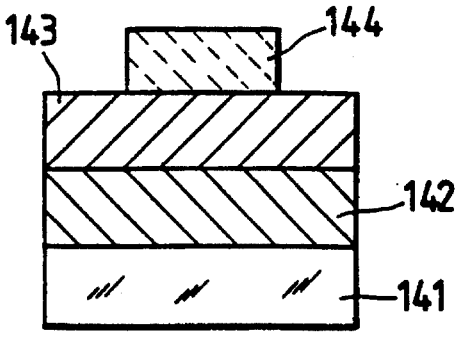
Figure 20C:
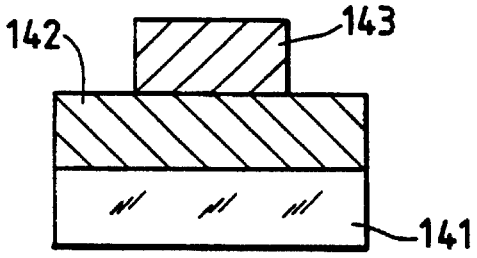
Figure 20D:
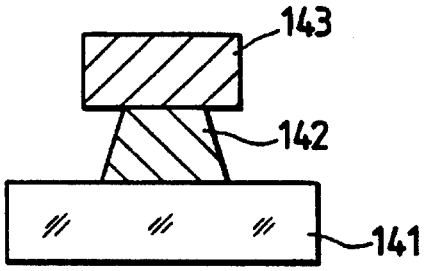
Figure 20E:
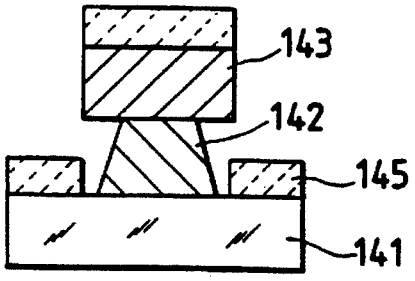
Figure 20F:
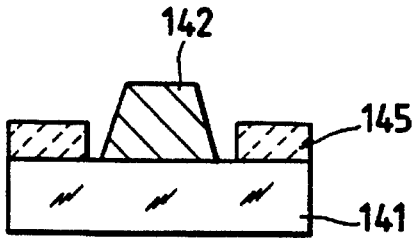
Figure 20G:
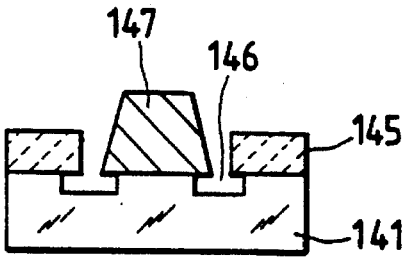
Figure 20H:
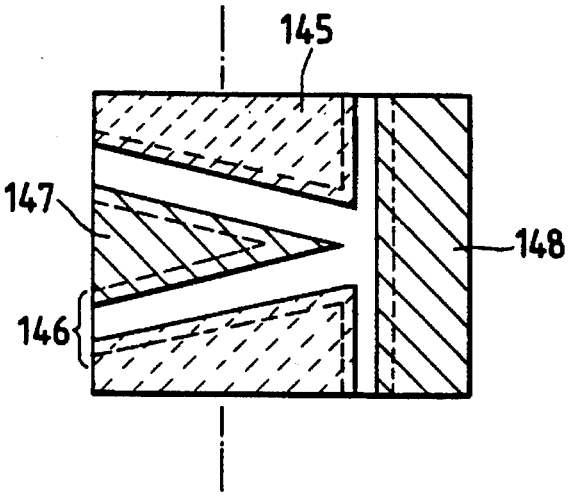

FIG. 20A is a plan view showing a first step on production processing of a function vacuum microelectronic field-emission device of the ninth embodiment of the invention. FIG. 20B shows a cross section taken on line H—H shown in FIG. 20A. FIG. 20C–20G show cross sections showing successive processing steps. FIG. 20H is a plan view in a completion step. Numeral 141 is a substrate, numeral 142 is a conductive layer, numeral 143 is a coat layer, numeral 144 is a photoresist, numeral 145 is a gate electrode layer, numeral 146 is a groove, numeral 147 is an emitter, and numeral 148 is a collector.

At first, as shown in FIG. 20A and FIG. 20B, the conductive layer 142 made of Mo, Ta, W, ZrC, and $LaB_6$, etc. and the coat material 143 is formed successively with a given thickness by deposition, or the spatter deposition, etc. on the substrate 141 made of glass, or ceramics, etc. On its surface, the photoresist 144 is formed by ordinal photolithography technique such that an width of at least a portion successively decreases in direction J and then, the width increases stepwise to an width of the substrate 141. Therefore, a constricted portion is made at a given portion of the photoresist 144. A metal or an insulation material can be used as the above-mentioned coating material. It may be a material capable of withstanding etching processing of the conductive layer 142 in a processing mentioned later and can be removed without corrosion of other materials. Then, as shown in FIG. 20C, the coating material 143 is etched using the photoresist 144 as a mask. Then, as shown in FIG. 20D, after removal of the photoresist 144, the conductive layer 142 is processed using the coating material 143 as a mask by wet-etching or dry-etching, etc. At this processing, the conductive layer 142 is side-etched to have a form whose size is smaller than the pattern shape of the coating material 143 by a given length. The emitter 147 is processed to have an wedge shape as shown in FIG. 20H showing the completion step and the collector 148 is formed a given interval apart from the emitter. Then, as shown in FIG. 20E, on its surface, the gate electrode material 145 made of Mo, Ta, Cr, Al, Au, etc., is formed on the stir face by deposition or the spatter, etc. Then, as shown in FIG. 20F, the coating material 143 is removed and at the same time, the gate electrode material 145 is removed to expose the conductive layer 142. Then as shown in FIG. 20G, a portion of the substrate 141 is etched using the conductive layer 142 and the gate electrode material 145 as a mask. The groove 146 is formed between the conductive layer 142 and the gate electrode material 145. This condition is shown in FIG. 20H. As mentioned, the conductive layer 142 having the wedge-shape by etching processing is used as an emitter 147. The conductive layer 142 formed a given interval apart from the emitter 147 is used as the collector 148.

As mentioned, according to the production method of the functional vacuum microelectronic field-emission device of this embodiment, reproducibility in production is high and stability of the functional vacuum microelectronic field-emission device can be improved because positioning is not necessary because patterning of the resist is performed only once and the position relation between emitter 147 and gate 146 and collector 148 which largely effects the characteristic of the functional vacuum microelectronic field-emission device can be controlled by side-etching width in etching processing and self-alignment is utilized. Moreover, a portion of the substrate 141 between the emitter 147 and gate 145 and the collector 148 is removed, so that the characteristic and the stability of the functional vacuum microelectronic field-emission device is further improved because occurrence of a leak current is prevented.

As mentioned, according to this invention, reproducibility in production and stability of the functional vacuum microelectronic field-emission device can be improved because the gap between the emitter and gate and gate and collector can be made narrow.

Moreover, in the production processing, the patterning of the resist is performed only once and self-alignment is utilized, so that the functional vacuum microelectronic field-emission device with high reproducibility can be readily obtained. Further, the interval between the emitter and the gate and the interval between the gate and collector are determined by using side-etching width in etching processing, so that there is provided a production method with a very high controlability and the functional vacuum microelectronic field-emission device with stable characteristic.

Hereinbelow will be described a tenth embodiment of this invention with reference to FIGS. 21 and 22.

Figure 21:
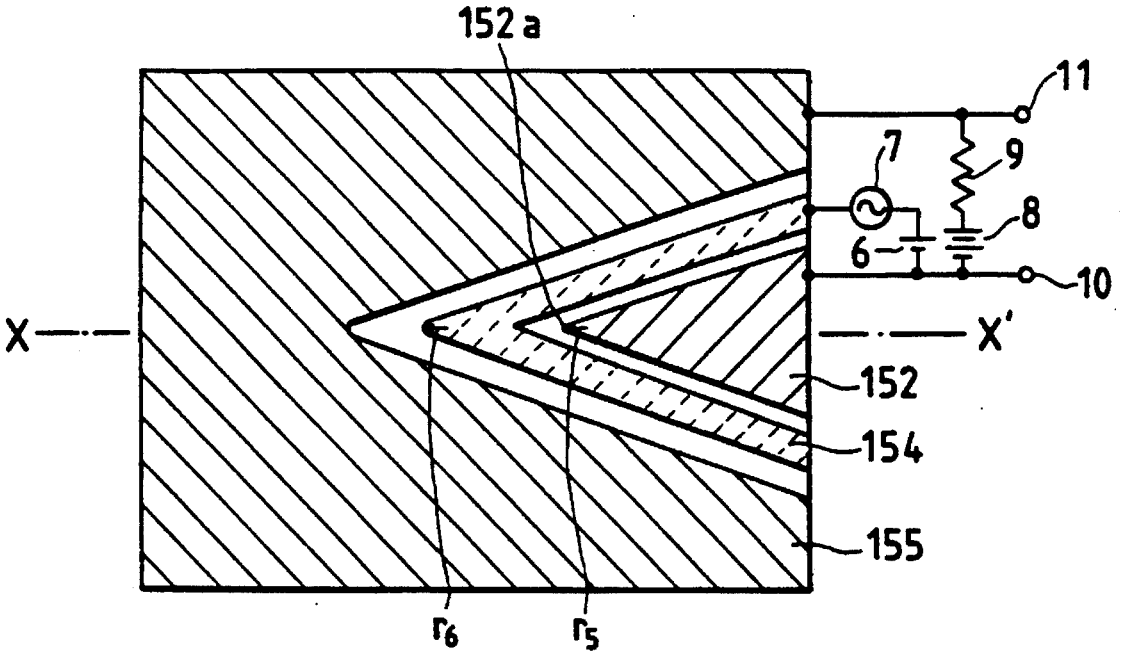
FIG. 21 is a plan view of a tenth embodiment of the invention of a functional vacuum microelectronic field-emission device.

FIG. 21 is a plan view of the tenth embodiment of the invention of a functional vacuum microelectronic field-emission device of the tenth embodiment of this invention. FIG. 22 shows a cross section taken on line X—X shown in FIG. 21. Portions with various markings in a plan view correspond to portions marked similarly in the corresponding cross-sectional view throughout the specification.

Figure 22:
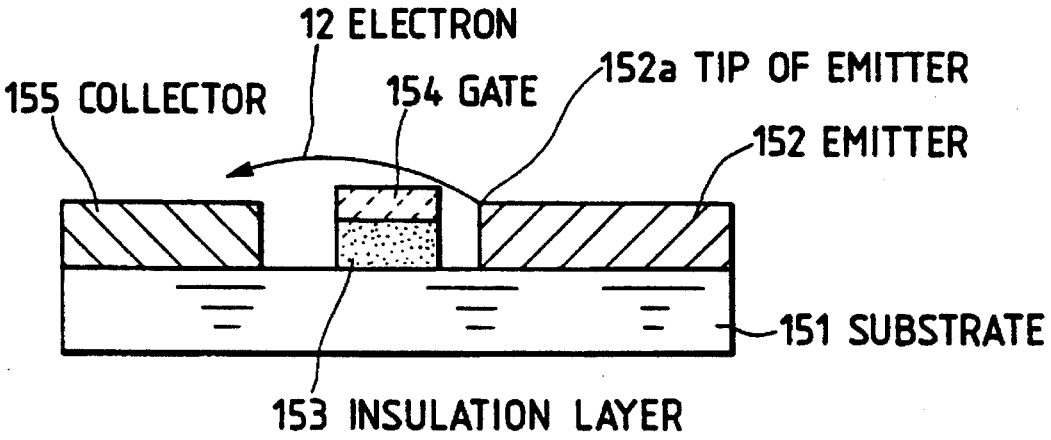
FIG. 22 shows a cross section taken on line X—X shown in FIG. 21.

As shown in FIGS. 21 and 22, an emitter 152 is formed on an insulation substrate 151 made of glass, ceramic, etc. The emitter 152 is made of a material having a low work function such as Mo, Ta, W, ZrC, $LaB_6$, etc. A width (shown in FIG. 21) of at least a portion of the emitter successively changes linearly, so that a tip **152*a* is formed sharply. That is, the emitter is formed to have an wedge portion. On the substrate 151, an insulation layer 153 made of $SiO_2$, $Si_3N_4$, $Al_2O_3$, $Ta_2O_5$, etc. is formed a given interval apart from the wedge portion of the emitter 152. On the insulation layer 153, at least a gate 154 made of Mo, Ta, Cr, Al, or Au, etc. is formed a given interval apart from the gate 154 on the outside of the wedge portion of emitter 152. In this embodiment the gate 154 is formed to have a V-shape. On the substrate 151, a collector made of Mo, Ta, Cr, Al, or Au, etc. is formed a given interval apart from the gate 154 on the outside of the gate 154 from the wedge portion of emitter 152. Numerals 6 and 7 are a bias power source and a signal input portion respectively. Numerals 8 and 9 are a collector power source and a resistor connected between the emitter 2 and collector 155. Numeral 10 and 11 are terminals. Numeral 12 shows electrons emitted from the tip 152*a* of the emitter 152. The tip 152***a* is formed to have a radius r5 of the tip 152*a* which is equal to or less than 1000 angstroms. On the other hand, The tip of the V-shaped gate 154 is formed to have a radius r6 thereof which is equal to or larger than 1 micrometer.

Hereinbelow will be described operation of the tenth embodiment.

As mentioned above, for example, the bias power supply 6 and the signal input portion 7 are connected between the emitter 152 and the gate 154. A collector power supply 8 and the resistor 9 are connected between the emitter 152 and the collector 155. This functional vacuum microelectronic field-emission device is placed in a vacuum space. At first, a suitable bias voltage is applied between the emitter 152 and gate 154 by the bias power supply 6. Then, when a suitable voltage is inputted from the signal input portion 7, the voltage between the emitter 152 and the gate 154 is a combined voltage of the bias voltage and the input signal voltage, so that an electric field whose intensity determined in accordance with the combined voltage. At this point, electric fields at respective surfaces of the emitter 152 are determined by geometrical position relations between the gate 154 and the respective surfaces of the emitter 152. As a result of a simulation analyzing about such arrangement, it has been known that lines of electric force are concentrated at the sharp tip 152*a* of the wedge portion of the emitter 152, that is, an electric field is strong at the tip 152*a*. Electron emission caused by electric fields at respect points of the emitter 152, which are determined in accordance with the combined voltage. In the wedge-shaped emitter 152, almost all electrons 12 can be emitted from the tip portion 152*a* of the emitter 152 because the electric field is strong at the tip 152*a* as mentioned above. In this state, electrons 12 emitted into the vacuum space can be taken into the collector 155 by application of a sufficient positive voltage to the collector power supply 8. Accordingly, a current flows through the resistor 9, so that a voltage between terminals 10 and 11 changes. That is, an output can be obtained as a change in the output voltage from the output terminal of the collector 155 in accordance with a voltage change of the signal input portion 7. Moreover, it is possible that a material having a low work function is selected as the material of the emitter 2 because anisotropic etching is not carried out. Therefore, the signal output level can be increased and S/N ratio is improved.

Hereinbelow will be described an eleventh embodiment of the invention with reference drawings. FIGS. 23A–23G show cross sections for showing an example of production processing of the functional vacuum microelectronic field-emission device of the eleventh embodiment.

Figure 23A:
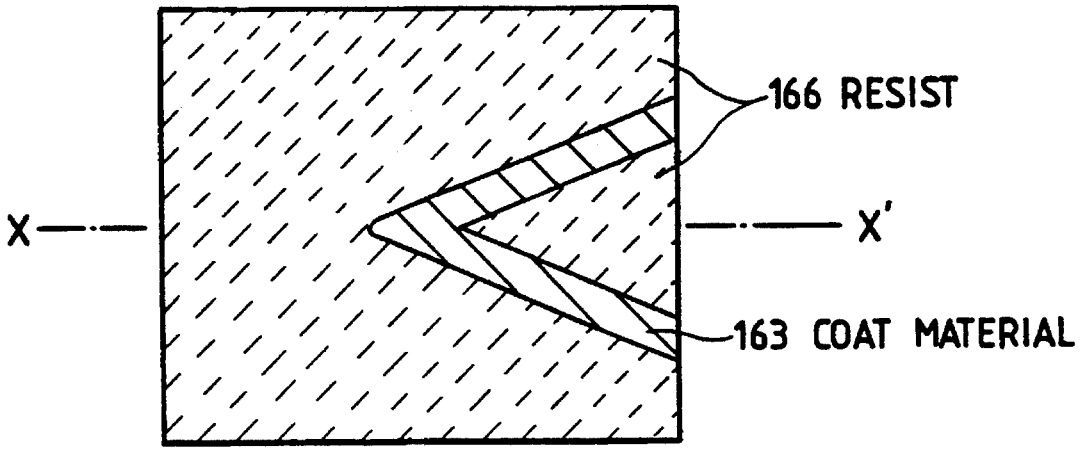
FIGS. 23A–23G show cross sections for showing an example of production processing of a functional vacuum microelectronic field-emission device of an eleventh embodiment.
Figure 23B:
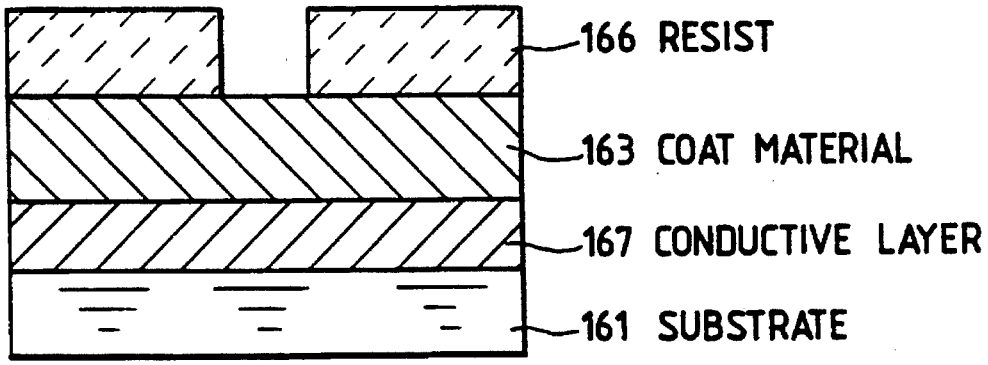
Figure 23C:
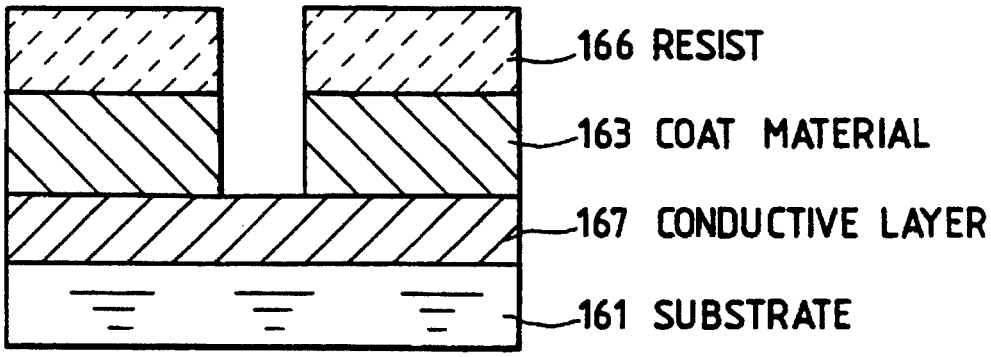
Figure 23D:
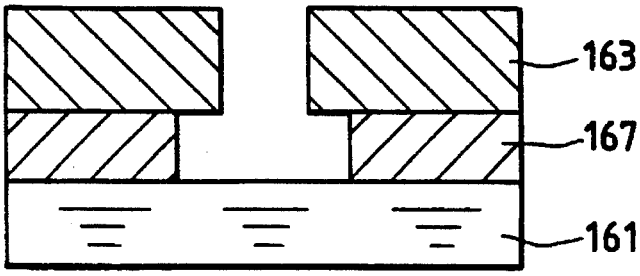
Figure 23E:
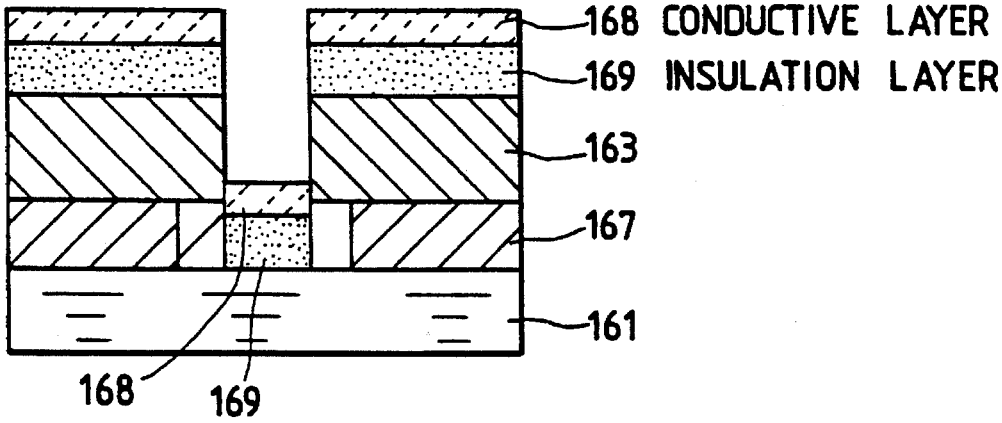
Figure 23F:
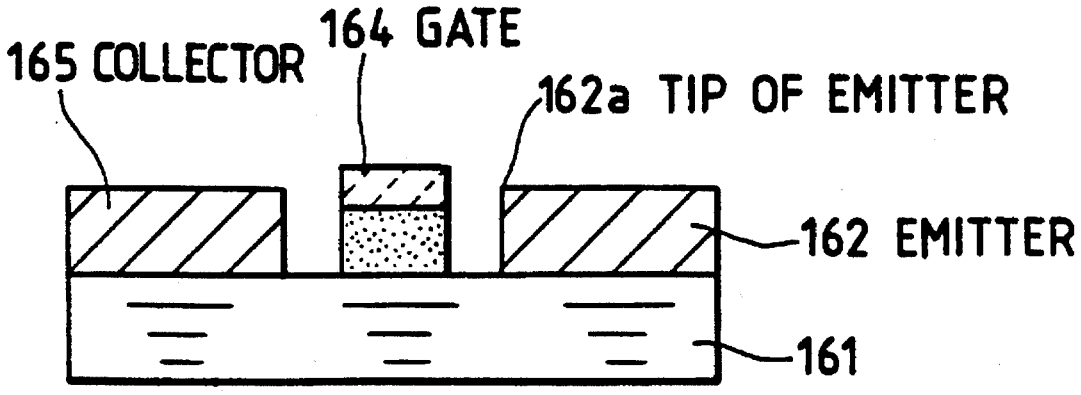
Figure 23G:
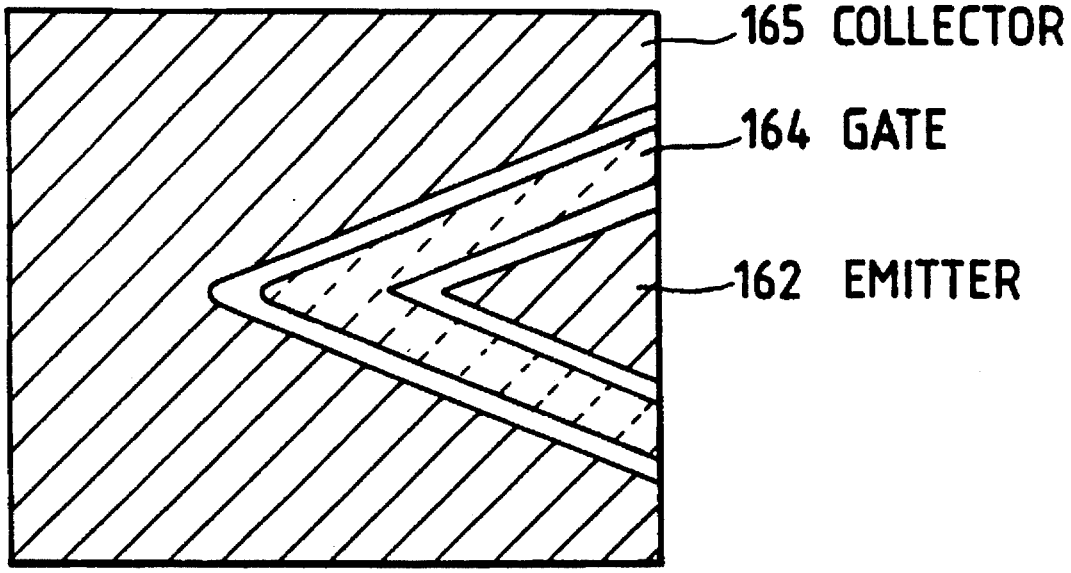
Figure 24:
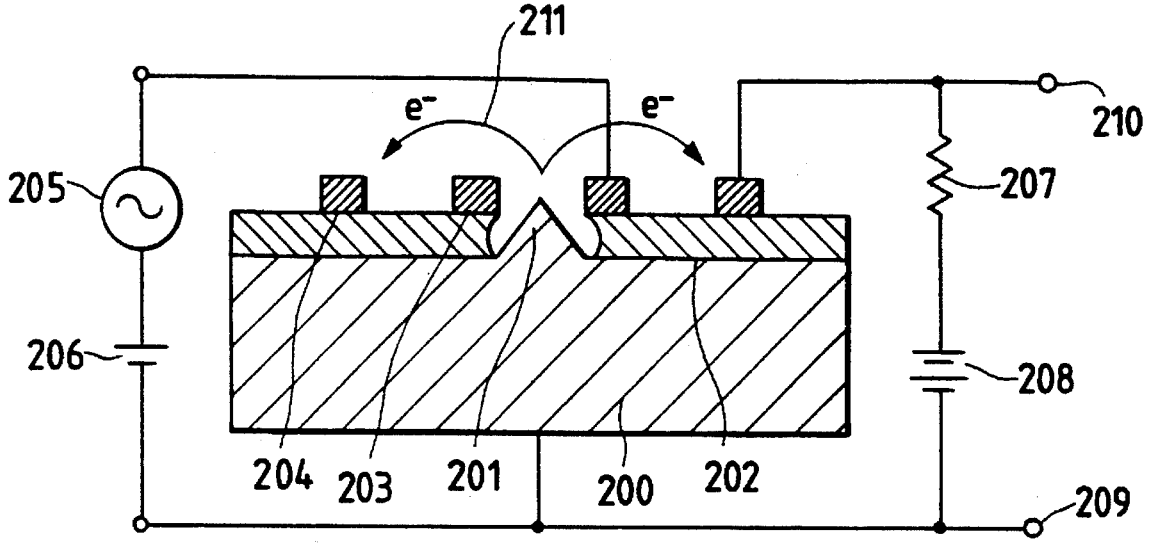
FIG. 24 PRIOR ART
FIG. 24 is a cross-sectional view of a prior art field-emission type vacuum transistor.
Figure 25:
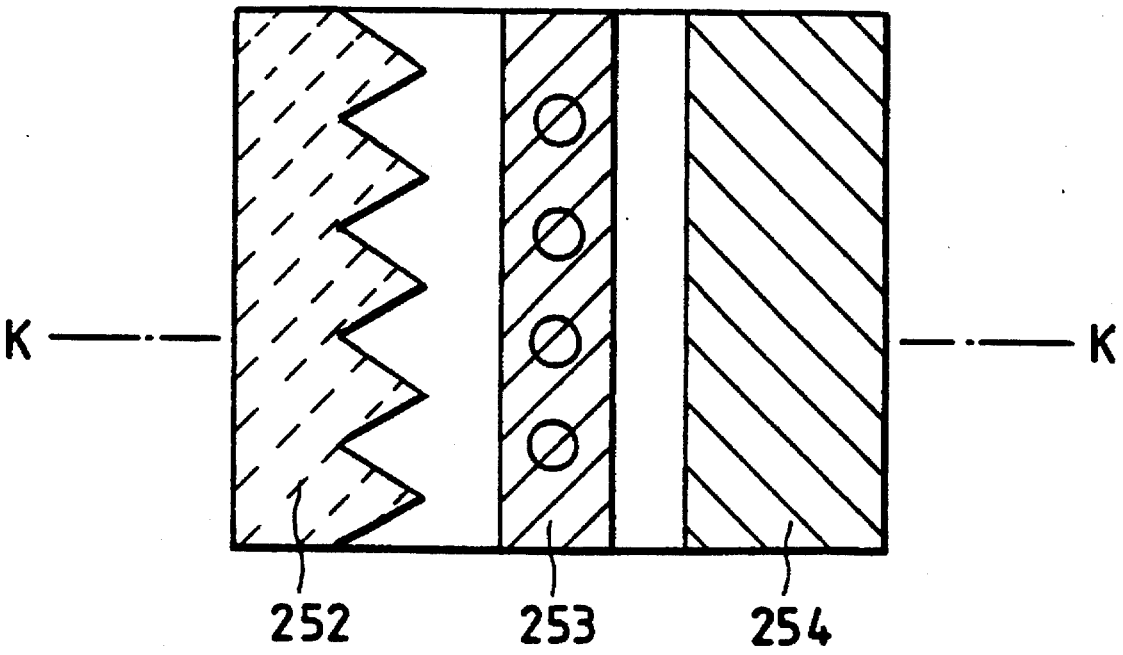
FIG. 25 PRIOR ART
FIG. 25 is a plan view of the three-terminal device of a prior art.
Figure 26:
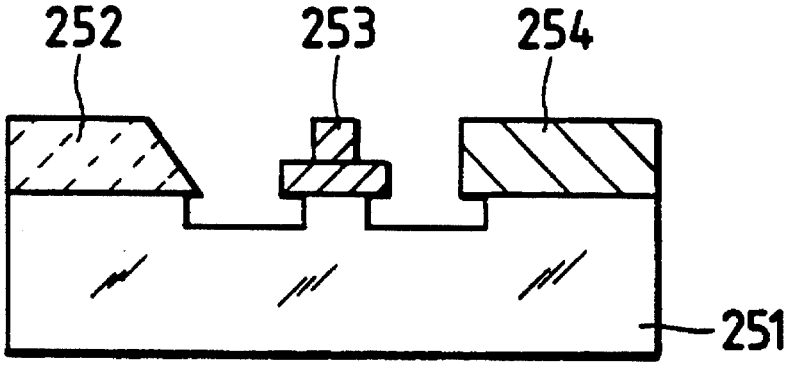
FIG. 26 PRIOR ART
FIG. 26 shows a cross section taken on line K—K shown in FIG. 25.
Figure 27A:
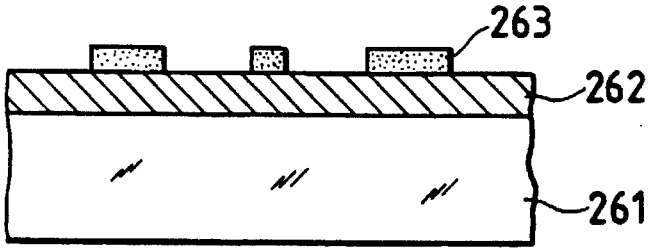
FIG. 27A PRIOR ART
FIGS. 27A–27E show cross sections for showing a production processing of the functional vacuum microelectronic field-emission device of the prior art three-terminal device of FIG. 25.
Figure 27B:
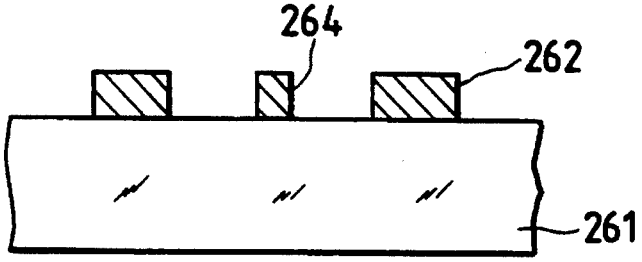
FIG. 27B PRIOR ART
Figure 27C:
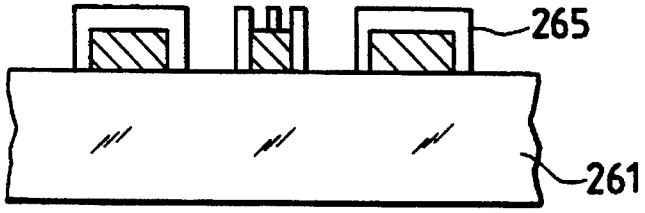
FIG. 27C PRIOR ART
Figure 27D:
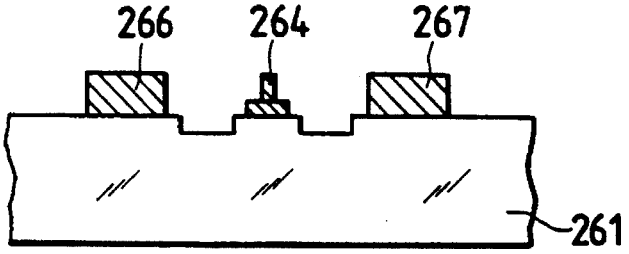
FIG. 27D PRIOR ART
Figure 27E:
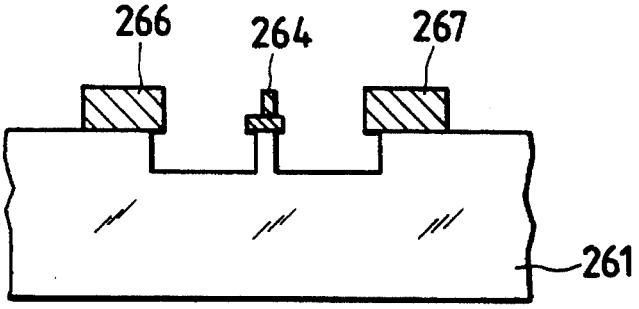
FIG. 27E PRIOR ART

FIG. 23A is a plan view showing a first step on production processing of a function vacuum microelectronic field-emission device of the ninth embodiment of the invention. FIG. 23B shows a cross section taken on line X'—X' shown in FIG. 23A. FIGS. 23C–23F show cross sections showing successive processing steps. FIG. 23G is a plan view in a completion step. Numeral 161 is a substrate, numeral 167 is a conductive layer, numeral 163 is a coat layer, numeral 166 is a photoresist, numeral 169 is an insulation layer, numeral 168 is another conductive layer, numeral 162 is an emitter, numeral 162*a* is a tip of emitter 162, numeral 164 is a gate, and numeral 165 is collector.

At first, as shown in FIG. 23A and FIG. 23B of a cross-sectional view taken on line X'—X' shown in FIG. 23A, the conductive layer 167 made of Mo, Ta, W, ZrC, and $LaB_6$, etc. and the coat material 163 are formed successively with given thickness by deposition, or the spatter deposition, etc. on the substrate 161 made of glass, or ceramics, etc. On its surface, the photoresist 166 is formed by ordinal photolithography technique such that an width of at least a portion successively changes. A metal or an insulation material can be used as the above-mentioned coating material. It may be a material capable of withstanding etching processing of the conductive layer 168 in a processing mentioned later and can be removed without corrosion of other materials. Then, as shown in FIG. 23C, the coating material 163 is etched using the photoresist 166 as a mask. Then, as shown in FIG. 23D, after removal of the photoresist 166, the conductive layer 167 is processed using the coating material 143 as a mask by wet-etching or dry-etching, etc. At this processing, the conductive layer 167 is side-etched to have a form whose size is smaller than the pattern shape of the coating material 163 by a given length. The emitter 167 is processed to have an wedge shape as shown in FIG. 23G showing the completion step and the collector 165 is formed with a given interval form the emitter 162. Then, as shown in FIG. 23E, on its surface, the the insulation layer 169 made of $SiO_2$, $Si_3N_4$, $Al_2O_3$, $Ta_2O_5$, etc. and the conductive layer 168 made of Mo, Ta, Cr, Al, Au, etc., are successively formed on the surface by deposition or the spatter, etc. Then, as shown in FIG. 23F, the coating material 163 is removed and at the same time, the insulation layer and the conductive layer 168 are removed to expose the conductive layer 167. The resultant form is shown in FIG. 23G. As mentioned, the conductive layer 167 having the wedge-shape by etching processing is used as the emitter 162. The conductive layer 168 formed on the insulation layer 169 is used as a gate 164. The conductive layer 167 formed a given interval apart from the emitter 162 is used as the collector 165.

As mentioned, according to the production method of the functional vacuum microelectronic field-emission device of this embodiment, reproducibility in production is high and stability of the functional vacuum microelectronic field-emission device can be improved because positioning is not necessary because patterning of the resist is performed only once and the position relation between emitter 162 and gate 164 and collector 165 which largely effects the characteristic of the functional vacuum microelectronic field-emission device can be controlled by side-etching width in etching processing and self-alignment is utilized.

As mentioned, according to this invention, reproducibility in production and stability of the functional vacuum microelectronic field-emission device can be improved because the gap between the emitter and gate and gate and collector can be made narrow.

Moreover, in the production processing, the patterning of the resist is performed only once and self-alignment is utilized, so that the functional vacuum microelectronic field-emission device with high reproducibility can be readily obtained. Further, the interval between the emitter and the gate and the interval between the gate and collector are determined by using side-etching width in etching processing, so that there is provided a production method with a very high controlability and the functional vacuum microelectronic field-emission device with stable characteristic.

What is claimed is:

1. A vacuum microelectronic field-emission device comprising:

(a) a substrate;

(b) an emitter portion formed on said substrate having at least a wedge portion extending in parallel to said substrate;

(c) a gate portion formed on said substrate, said gate portion having a V-shape continuous edge confronting said wedge portion, said gate portion being electrically insulated from said substrate and said emitter portion; and (d) a collector portion formed on said substrate, said collector portion confronting said emitter portion and said gate portion such that said gate portion is disposed between said wedge portion and said collector portion, said collector portion being electrically insulated from said substrate, said emitter portion, and said gate portion.

2. A vacuum microelectronic field-emission device comprising:

(a) a substrate;

(b) an emitter portion formed on said substrate, said emitter portion having a wedge portion extending in parallel to said substrate, wherein a width of at least a portion of said wedge portion varies successively;

(c) a collector portion formed on said substrate and electrically insulated from said substrate, said collector portion spaced apart from said emitter portion by a first predetermined interval; and (d) a gate portion formed on said emitter portion and spaced apart from said substrate by a second predetermined interval, said gate portion being electrically insulated from said substrate, wherein said first predetermined interval is not smaller than said second predetermined interval, and said gate portion is between said emitter portion and sand collector portion, said collector portion having a V-shape continuous edge confronting said wedge portion.

3. A vacuum microelectronic field-emission device comprising:

(a) a substrate;

(b) an emitter portion formed on said substrate, said emitter portion having at least a wedge portion extending in parallel to said substrate;

(c) a gate portion on said substrate, said gate portion having a V-shape continuous edge confronting said wedge portion and spaced apart from a tip of said emitter portion by a first predetermined distance along said substrate, said gate portion being electrically insulated from said substrate and from said emitter portion; and (d) a collector portion on said substrate, said collector portion spaced apart from said tip of said emitter portion by a second predetermined distance along said substrate, said collector portion being electrically insulated from said substrate, from said emitter portion, and from said gate portion, wherein said second predetermined distance is not smaller than said first predetermined distance, and said gate portion is disposed between said collector portion and said emitter portion.

4. A vacuum microelectronic field-emission device as claimed in claim 3, further comprising an insulation layer formed a third predetermined distance apart from said tip such that said insulation layer is sandwiched between said gate portion and said substrate, said insulation layer providing electrical insulation of said gate portion from said substrate.

5. A vacuum microelectronic field-emission device as claimed in claim 4, wherein said insulation layer extends such that said insulation layer is further sandwiched between said collector portion and said substrate, said insulation layer further providing electrical insulation of said collector portion from said substrate.

6. A vacuum microelectronic field-emission device as claimed in claim 3, wherein said substrate comprises a conductive material, said vacuum microelectronic field-emission device further comprising an insulating means for electrically insulating said gate portion from said substrate and from said emitter portion, and for electrically insulating said collector portion from said substrate, said emitter portion and said gate portion.

7. A vacuum microelectronic field-emission device as claimed in claim 6, wherein said insulating means comprises an insulation layer sandwiched between said collector portion and said substrate.

8. A vacuum microelectronic field-emission device as claimed in claim 6, wherein said insulating means comprises an insulation layer sandwiched between said gate portion and said substrate.

9. A vacuum microelectronic field-emission device as claimed in claim 3, wherein said substrate comprises an insulation material.

10. A vacuum microelectronic field-emission device as claimed in claim 3, wherein said tip of said emitter portion has a semicircle portion having a radius less than 1000 angstroms.

11. A vacuum microelectronic field-emission device as claimed in claim 3, wherein said gate portion extends along a portion of edges of said wedge portion and a tip of said V-shaped gate portion has a semicircle portion having a radius larger than one micrometer.

12. A vacuum microelectronic field-emission device comprising:

(a) a substrate;

(b) an emitter portion on a surface of said substrate and separated therefrom by insulation, said emitter portion having at least a wedge portion extending along said surface, wherein said wedge portion has a width successively varying in a direction in parallel to said surface;

(c) a gate portion on said substrate and separated therefrom by a first insulation, said gate portion spaced apart from a tip of said emitter portion by a predetermined distance;

(d) an insulation layer formed on said gate portion; and (e) a collector portion formed on said insulation layer.

13. A vacuum microelectronic field-emission device comprising:

(a) a substrate;

(b) an emitter portion formed on a surface of said substrate to have at least a wedge portion having a width varying in a direction parallel to said surface of said substrate, said emitter portion being electrically connected to a conductive layer on said substrate, said emitter portion being electrically insulated from said substrate;

(c) a gate portion formed on said substrate and spaced apart from a tip of said emitter portion on said substrate by a first predetermined distance, said gate portion substantially surrounding said emitter portion, said gate portion being electrically insulated from said substrate and from said emitter portion; and (d) a collector portion formed on said substrate and spaced apart from said tip of said emitter portion on said substrate by a second predetermined distance, said collector portion substantially surrounding said gate portion, said collector portion being electrically insulated from said substrate and said emitter and said gate portions.

14. A vacuum microelectronic field-emission device as claimed in claim 13, wherein said emitter portion has a plurality of wedge portions.

15. A vacuum microelectronic field-emission device as claimed in claim 13, further comprising:

an insulation layer formed a third predetermined distance apart from a tip of said emitter, said insulation layer covering a portion of said substrate and a portion of said conductive layer, said insulation layer supporting said gate and collector portions, said insulating layer and said emitter portion being formed such as to expose said conductive layer to cause it to function as a lead terminal.

16. A vacuum microelectronic field-emission device as claimed in claim 13, wherein said substrate comprises an electrically conductive material, said vacuum microelectronic field-emission device further comprising an insulation layer having a hole exposing a portion of said emitter portion to said substrate.

17. A vacuum microelectronic field-emission device as claimed in claim 13, wherein said tip has a semicircle portion having a radius less than 1000 angstroms.

18. A vacuum microelectronic field-emission device as claimed in claim 13, wherein said gate portion has a V-shape such that said gate portion extends along a portion of edges of said wedge portion, and wherein a tip of said V-shaped gate portion has a semicircle portion having a radius larger than one micrometer.

19. A vacuum microelectronic field-emission device comprising:

(a) a substrate;

(b) an emitter portion formed on said substrate and having at least a first wedge portion extending in parallel to said substrate and including plural edges, said emitter portion being electrically insulated from said substrate;

(c) a gate portion formed on said substrate and spaced apart from a tip of said emitter portion by a first predetermined distance, said gate portion having at least a second wedge portion including plural edges, with a first insulation disposed between said gate portion and said substrate, one of the edges of said first wedge portion being parallel to one of the edges of said second wedge portion; and (d) a collector portion formed on said substrate and spaced apart from a tip of said emitter portion by a second predetermined distance, a second insulation disposed between said collector portion and said substrate, wherein said second predetermined distance is not smaller than said first predetermined distance.

20. A vacuum microelectronic field-emission device as claimed in claim 19, wherein said substrate has a groove between said emitter portion and said collector portion.

21. A vacuum microelectronic field-emission device as claimed in claim 19, wherein said substrate has a groove between said emitter portion and said gate portion.

22. A vacuum microelectronic field-emission device as claimed in claim 19, wherein said substrate has a groove between said gate portion and said collector portion.

23. A vacuum microelectronic field-emission device comprising:

(a) a substrate;

(b) an emitter portion formed on said substrate to have at least a wedge portion extending in parallel to said substrate, said emitter portion being electrically connected to a conductive layer on said substrate, said emitter portion being electrically insulated from said substrate;

(c) a gate portion formed on said substrate and spaced apart from a tip of said emitter portion on said substrate by a first predetermined distance, said gate portion substantially surrounding said emitter portion, said gate portion being electrically insulated from said substrate and from said emitter portion; and (d) a collector portion formed on said substrate and spaced apart from said tip of said emitter portion on said substrate by a second predetermined distance, said collector portion substantially surrounding said gate portion, said collector portion being electrically insulated from said substrate and from said emitter and said gate portions, wherein said emitter portion has a plurality of wedge portions.

24. A vacuum microelectronic field-emission device comprising:

(a) a substrate;

(b) an emitter portion formed on said substrate to have at least a wedge portion extending in parallel to said substrate, said emitter portion being electrically connected to a conductive layer on said substrate, said emitter portion being electrically insulated from said substrate;

(c) a gate portion formed on said substrate and spaced apart from a tip of said emitter portion on said substrate by a first predetermined distance, said gate portion substantially surrounding said emitter portion, said gate portion being electrically insulated from said substrate and from said emitter portion; and (d) a collector portion formed on said substrate and spaced apart from said tip of said emitter portion on said substrate by a second predetermined distance, said collector portion substantially surrounding said gate portion, said collector portion being electrically insulated from said substrate and from said emitter and said gate portions, further comprising:

an insulation layer formed a third predetermined distance apart from a tip of said emitter, said insulation layer covering a portion of said substrate and a portion of said conductive layer, said insulation layer supporting said gate and collector portions, said insulation layer and said emitter portion being formed such as to expose said conductive layer to cause it to function as a lead terminal.

25. A vacuum microelectronic field-emission device comprising:

(a) a substrate;

(b) an emitter portion formed on said substrate to have at least a wedge portion extending in parallel to said substrate, said emitter portion being electrically connected to a conductive layer on said substrate, said emitter portion being electrically insulated from said substrate;

(c) a gate portion formed on said substrate and spaced apart from a tip of said emitter portion on said substrate by a first predetermined distance, said gate portion substantially surrounding said emitter portion, said gate portion being electrically insulated from said substrate and from said emitter portion; and (d) a collector portion formed on said substrate and spaced apart from said tip of said emitter portion on said substrate by a second predetermined distance, said collector portion substantially surrounding said gate portion, said collector portion being electrically insulated from said substrate and from said emitter and said gate portions, wherein said substrate comprises an electrically conductive material, said vacuum microelectronic field-emission device further comprising an insulation layer having a hole exposing a portion of said emitter portion to said substrate.

26. A vacuum microelectronic field-emission device comprising:

(a) a substrate;

(b) an emitter portion formed on said substrate to have at least a wedge portion extending in parallel to said substrate, said emitter portion being electrically connected to a conductive layer on said substrate, said emitter portion being electrically insulated from said substrate;

(c) a gate portion formed on said substrate and spaced apart from a tip of said emitter portion on said substrate by a first predetermined distance, said gate portion substantially surrounding said emitter portion, said gate portion being electrically insulated from said substrate and from said emitter portion; and (d) a collector portion formed on said substrate and spaced apart from said tip of said emitter portion on said substrate by a second predetermined distance, said collector portion substantially surrounding said gate portion, said collector portion being electrically insulated from said substrate and from said emitter and said gate portions, wherein said gate portion has a V-shape such that said gate portion extends along a portion of edges of said wedge portion, and wherein a tip of said V-shaped gate portion has a semicircle portion having a radius larger than one micrometer.

* * * * *